US012502618B2

(12) United States Patent
Hsu

(10) Patent No.: US 12,502,618 B2
(45) Date of Patent: Dec. 23, 2025

(54) FIDGET WALKER WITH HAPTIC AND ACOUSTIC FEEDBACK

(71) Applicant: Fred Hsu, Port Washington, NY (US)

(72) Inventor: Fred Hsu, Port Washington, NY (US)

( * ) Notice: Subject to any disclaimer, the term of this patent is extended or adjusted under 35 U.S.C. 154(b) by 403 days.

(21) Appl. No.: 18/167,860

(22) Filed: Feb. 12, 2023

(65) Prior Publication Data

US 2023/0285870 A1 Sep. 14, 2023

Related U.S. Application Data

(60) Provisional application No. 63/484,415, filed on Feb. 10, 2023.

(51) Int. Cl.
*A63H 33/26* (2006.01)

(52) U.S. Cl.
CPC ..... *A63H 33/26* (2013.01)

(58) Field of Classification Search
CPC ..... A63H 33/26; A63F 7/068; A63F 7/0088; A63F 7/26; A63F 7/265; A63F 2003/00927; A63F 2003/0093
USPC ..... 446/129, 131, 132, 133, 135; 273/118 R, 273/118 A, 126 A, 443, 456
See application file for complete search history.

(56) References Cited

U.S. PATENT DOCUMENTS 1,533,540 A * 4/1925 Craigen ..... A63F 9/14 273/443
1,988,071 A * 1/1935 Bryn ..... A63F 7/0628 273/443
2,463,795 A * 3/1949 Neuzerling ..... A63F 9/14 273/443
2,492,423 A * 12/1949 Gray ..... A63F 7/068 446/139
2,525,738 A * 10/1950 Tormey ..... A63F 9/14 273/153 R
2,632,648 A * 3/1953 Neuzerling ..... A63F 9/14 273/108
3,106,042 A * 10/1963 Roethler ..... G09B 25/02 434/305
3,214,171 A * 10/1965 Luchsinger ..... A63F 7/068 273/443
3,433,478 A * 3/1969 Span ..... A63F 7/0088 273/443
3,625,516 A * 12/1971 Handweiler ..... A63F 9/0078 273/443
3,712,617 A * 1/1973 Ohlschlager ..... A63F 7/047 273/443
3,782,726 A * 1/1974 Huffman ..... A63F 7/3603 273/443

(Continued)

FOREIGN PATENT DOCUMENTS

DE 2643884 A1 * 11/1980
GB 191500526 A * 11/1915 ..... A63F 7/0088

*Primary Examiner* — Alexander R Niconovich

(57) ABSTRACT

A fidgetable device that relays haptic feedback via magnetic coupling to hands and fingers, when an operator uses an outside magnet to drag an inside magnet over a rugged interior surface. This haptic experience is akin to walking a pet on a retractable leash. Thus the designation fidget walker. Said haptic device, with its acoustic side effects, is also widely applicable in a variety of fields including percussion instruments, underwater switches, magnetic locks, tabletop games, and even automated machineries.

20 Claims, 21 Drawing Sheets

(56) References Cited

U.S. PATENT DOCUMENTS

| | | | | | |
|---|---|---|---|---|---|
| 3,785,648 | A * | 1/1974 | Kobayashi | A63F 7/068 | 273/443 |
| 3,940,135 | A * | 2/1976 | Cohen | A63F 7/068 | 273/443 |
| 4,834,371 | A * | 5/1989 | Hay | A63F 7/068 | 273/443 |
| 4,838,825 | A * | 6/1989 | Hwang | A63H 13/20 | 40/426 |
| 5,540,187 | A * | 7/1996 | Udelle | A01K 15/025 | 119/706 |
| 6,076,827 | A * | 6/2000 | Luchsinger | A63F 7/068 | 273/129 R |
| 6,457,710 | B1 * | 10/2002 | Bisbee | A63F 7/06 | 273/443 |
| 6,561,511 | B1 * | 5/2003 | Vaysberg | A63F 7/068 | 273/443 |
| 8,013,550 | B1 * | 9/2011 | Young | A63H 19/24 | 446/7 |
| 8,030,871 | B1 * | 10/2011 | Young | A63H 19/24 | 446/7 |
| 11,960,686 | B2 * | 4/2024 | Chappaz | G06F 3/0393 | |
| 2022/0113803 | A1 * | 4/2022 | Rosenberg | G06F 3/047 | |

* cited by examiner

FIDGET WALKER WITH HAPTIC AND ACOUSTIC FEEDBACK

CROSS-REFERENCE TO RELATED APPLICATIONS

This application claims the benefit of U.S. Provisional Patent Application No. 63/484,415, filed Feb. 10, 2023, which is incorporated by reference herein in its entirety.

TECHNICAL FIELD OF THE INVENTION

Various embodiments of the present disclosure relate to a haptic feedback device, and in particular to a fidgetable device that relays changes in and effects of magnetic coupling to fingers both haptically and acoustically. Said haptic feedback and accompanying acoustic effects make said device widely applicable in a variety of fields including percussion instruments, underwater switches, magnetic locks, tabletop games, and even automated machineries.

BACKGROUND OF THE INVENTION

Fidget toys became a sensation in 2017, with the introduction of fidget spinners. Since then new classes of fidget toys have been found and popularized, including fidget cubes, fidget rings, fidget sliders, and fidget coins. Some of these fidget toys leverage magnetic materials to provide direct tactile, indirect haptic, and acoustic feedback to users. For instance, fidget sliders and fidget coins have magnets permanently embedded in distinct fidget pieces which a user first separates by force, and then lets snap back together by magnetic attraction. Only a handful of fidget toy classes exist, and enthusiasts continue to search for new classes to commercialize.

Percussion instruments have existed as long as *Homo sapiens* has been around. Simple instruments such as washboards, maracas, sticks and log drums come to mind. More complex percussion instruments include castanets and ratchets, also known as cog rattles. In modern times, electronic versions abound. But these produce no tactile feedback to musicians. Even today, musicians and sound effect technicians continue to look for new mechanical implements to produce distinct percussive sounds in simpler, cheaper, and more effective ways.

Another ancient creation of our species is the latch for keeping doors closed. A modern incarnation of the latch is the electric toggle switch. These usually have a mechanical component such as a rocker to open and close an electric contact. The rocker produces at the same time tactile feedback to an operator to indicate that a desired state has been reached. Waterproofing such switches for underwater use involves elaborate design and manufacturing. In some cases, magnets and hall sensors are used to eliminate traditional mechanical switch components, and to insulate electric components inside a waterproof casing. However, this design lacks tactile and acoustic feedback produced by traditional mechanical switches.

Another progeny of primitive latches is the lock. A lock usually consists of a fastening device and a removable key. Only a key made to open a particular lock can unlock said lock. Today, magnetic locks abound. Unlike traditional locks, magnetic locks can be made such that they leave a plain and unblemished exterior surface. A simple version is widely used to childproof cabinet doors. A key with a magnet is held by an operator to attract and shift a bolt into or out of a hole. More complex ones use multiple magnets that need to be arranged in particular patterns in order to release a bolt. These magnetic locks do provide some tactile feedback when they engage or disengage. But they do not provide enough fine-grained tactile and acoustic feedback, for instance, to emulate rotary combination dials.

There exists a type of tabletop games where players hold a magnet under a smooth underside surface, to manipulate playing pieces moving on a smooth topside surface. One popular variation employs playing pieces looking like soccer figurines to push a rolling ball around a soccer field. Another type of tabletop games allows a player to guide a steel ball encased in a maze, with a magnet from outside the case. In general, these games provide a smooth, plain surface for both the topside and the underside of a plate separating the playing piece from the magnet. Even today, game makers continue to search for new game types, or new ways to introduce novel experiences in established game types.

SUMMARY OF THE INVENTION

Some embodiments of the present disclosure include a device where a control magnet is used to drag an escorted magnet over a rugged surface. A device may comprise a plate to separate a control peg under the plate, from an escorted item on its uneven surface terrain. Features of the rugged terrain causes the escorted item to move closer to or farther from the control peg, as the escorted item is dragged across the terrain. This change in distance between the control peg and the escorted item affects the strength of the magnetic coupling between them, and can be felt as tactile or haptic feedback by fingers, or measured by instruments.

In addition, the actual height trajectory of an escorted item may differ from the height profile of a rugged terrain, due to physical interactions between the item's outer shape and the shape of terrain features. The planar trajectory of an escorted item may differ from that of a control peg, if barriers and guardrails are enacted on the terrain to interact with the escorted item, or to reroute movements of the escorted item. Both height and planar interactions may produce various types of acoustic feedback.

The haptic and acoustic feedback of an item dragged across a rugged terrain finds applications in a variety of fields. Some advantages of said embodiment of the present disclosure include: novel sensory experiences, simplicity of mechanical design, low cost of manufacturing, reduced size of the device compared to traditional counterparts, effectiveness of both haptic and acoustic feedback, and the realism of an emulated experience modeled after traditional counterparts. These are recurring themes that will be repeated and elaborated in the present disclosure for different applications, using the same basic principles outlined above.

As an example, and referencing FIG. 1A, I present an embodiment of these basic principles applied in the field of fidget toys. A new class of fidget toy is created by the application of an escorted item 40 dragged over a rugged terrain 20. I call the device 110 a fidget walker, because the haptic feedback experienced by an operator holding and moving a control peg 50 is akin to walking an escorted pet 40 on a retractable leash. FIG. 1D illustrates the same fidget walker 110, now flipped upside down to expose the underside region 30 of the plate 10. This device is clearly recognizable in this illustration as a miniature fidget emulation of a shift stick in a 5-gear manual transmission vehicle, as shown in FIG. 1E. Fidget walker 110 provides haptic and acoustic feedback similar to a real gear shift, albeit in miniature, and in a drastically simplified design.

As another example, and referencing FIG. 2E, I present a different embodiment of fidget walkers. This fidget walker may form the basis for mechanical and electric switches for use underwater, as well as magnetic locks with enhanced haptic and acoustic feedback. In device 212, there are two valley locations 22 on a surface terrain 20, where an escorted item 40 remains in a stable configuration, when magnetically coupled to a control peg 50 across plate 10. Moving control peg 50 and thus dragging escorted item 40 back and forth across hill 26 between these two locations produce haptic and acoustic feedback approximating a mechanical toggle switch. Unlike traditional switches, device 212 comes with its own waterproofing shield in the form of plate 10 which can be shaped to completely segregate control peg 50 from the rest of the device. It is straightforward for those skilled in the art to add additional mechanical parts and/or electronic sensors, such as hall effect sensors, to interact with escorted item 40 or control peg 50, creating new types of underwater switches and magnetic locks.

Referencing FIG. 3C, I present an embodiment of fidget walkers which emulates haptic and acoustic feedback of a discrete slide control on a dimmer switch. Device 312 replaces the hill terrain feature of device 212 with a plateau 28, and a series of bumps 23 over the plateau. This introduces a number of trenches 25 each able to capture escorted item 40 in a stable magnetic configuration, in addition to the two valleys 22. Such a graduated surface terrain 20 may form the basis for underwater or waterproof dimmer switches, again by having additional mechanical parts and/or electronic sensors interact with escorted item 40 or control peg 50. Graduated switches thus created will find ample applications in swimming pools, hot tubs, showers, home aquariums, remote-controlled boats, real boats, and outdoor equipment. Device 312 may also be used to create magnetic combination locks. For instance, 3 strips of a variant of device 312 each with 10 stable magnetic configurations yields 10^3, or 1,000 combinations.

Referencing FIG. 4B, I present an embodiment of fidget walker emulating a ratchet wrench, or a percussive ratchet instrument known as a cog rattle. A valley 22, a slope 24 and a cliff 27 form one tooth. There are twelve teeth in a disk-shaped device 412. When a control peg 50 is moved in a circle, an escorted item 40 will be dragged between two guardrails 70, making twelve clicks both in sound and in haptic feedback, reminiscent of a ratchet. In fact, device 412 makes the same sound as a cog rattle, in a simpler form and a smaller package. Furthermore, multiple concentric terrain paths with different tooth shapes may be packed into one single combined device, to produce different ratchet sounds in a single musical instrument. Such a complex instrument will still comprise simply four types of components: a plate 10 with terrain features, one escorted item for each terrain path, an enclosure 60, and a control peg 50. This multi-path ratchet instrument may also form the basis for a magnetic combination dial of a safe, with the same haptic and acoustic feedback afforded by a traditional mechanical dial.

One skilled in the art will also appreciate how these basic principles can be applied to tabletop games, to introduce new sensory feedback, to enhance existing classes of games, or to create new classes of games altogether. Many embodiments are amenable to be manipulated by human hands. But a control peg is not the only object that can be manipulated. A hand may instead shuffle a fidget walker enclosure against a mounted control peg. Furthermore, some embodiments may not require human interactions at all. For instance, escorted items, control pegs and enclosures may be operated by machines, while mechanical levers, springs and pistons are used to mechanically detect positions of either an escorted item or a control peg. Alternatively, electronic sensors can be employed for detections. These will allow automated machineries, underwater or otherwise, to leverage the same basic principles disclosed herein.

REFERENCE NUMERALS

Figure 1A:
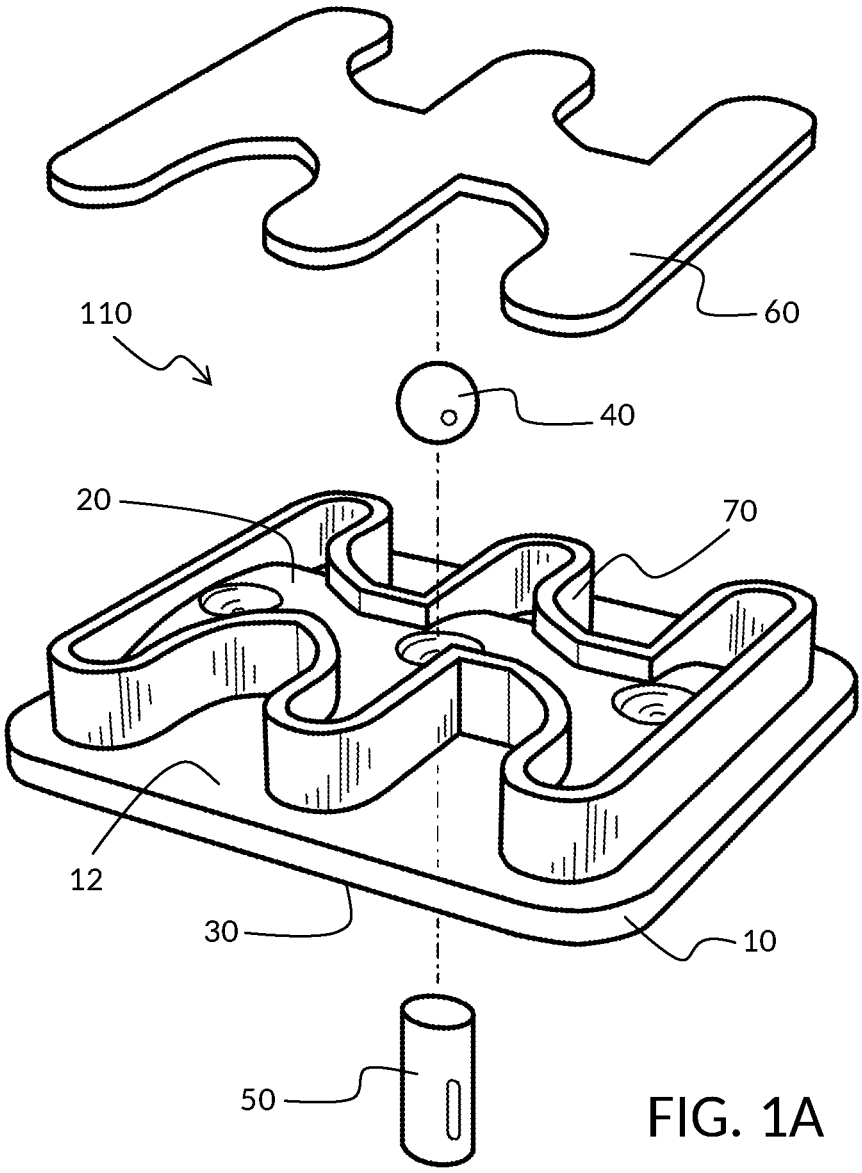
FIG. 1A is a perspective view of an embodiment of the present disclosure, showing a fidget walker device 110 that emulates haptic and acoustic feedback from a shift stick in a 5-gear manual transmission vehicle, depictured in FIG. 1E.

It is noted that like parts are designated by like reference numerals throughout the accompanying drawings. A list of numbered parts is presented below:

10. A plate with a surface terrain and an underside region.
12. An outside space on plate 10 which is not part of surface terrain 20.
14. A center space on plate 10 which is not part of surface terrain 20.
20. Surface terrain of a plate 10.
21. A depression terrain feature.
22. A valley terrain feature.
23. A bump terrain feature.
24. A slope terrain feature.
25. A trench terrain feature.
26. A hill terrain feature.
27. A cliff terrain feature.
28. A plateau terrain feature.
29. A terrain path formed by a number of terrain features.
30. Underside region of a plate 10.
34. A hook flanking underside region 30 from one side.
40. An escorted item on and supported by a surface terrain 20.
42. Movement trajectory of an escorted item 40.
50. A control peg situated under plate 10 close to underside region 30.
52. Movement trajectory of a control peg 50.
53. A thin brim attached to a control peg 50 to allow a peg clip to retain the peg.
54. A flange protrusion on one side of control peg magnet 50.
55. A clip attachable to underside region 30 that holds a control peg by its peg brim.
56. A hook flanking control peg magnet from one side.
57. A center slot 57 cut out of peg clip 55.
60. An enclosure that surrounds a surface terrain to keep an escorted item within.
70. Guardrails on a surface terrain to limit XY movements of an escorted item.
80. Elevation profile of a terrain feature.
82. Elevation profile of a terrain path.
110. A fidget walker that emulates a shift stick in a 5-gear manual transmission vehicle.
210. A fidget walker that emulates a mechanical toggle switch.
212. A fidget walker that emulates a toggle switch with enclosure 60.
214. A toggle-switch fidget walker with enclosure 60 and peg clip 55.
216. A toggle-switch fidget walker with a T-slot to receive a T-slide control peg.
218. A toggle-switch fidget walker with a control peg that clamps onto plate 10.
310. A fidget walker that emulates a discrete slide control on a dimmer switch.
312. A fidget walker that emulates a discrete dimmer with enclosure 60.
410. A fidget walker that emulates a mechanical ratchet.
412. A fidget walker that emulates a mechanical ratchet with guardrails 70 and enclosure 60.

DETAILED DESCRIPTION

Further areas of applicability of the present disclosure will become apparent from the detailed description provided hereinafter. It should be understood that the detailed description and specific examples, while indicating some embodiments of the disclosure, are intended for purposes of illustration only and are not intended to limit the scope of the disclosure.

First Embodiment: Simple Toggle Switch

Figure 2A:
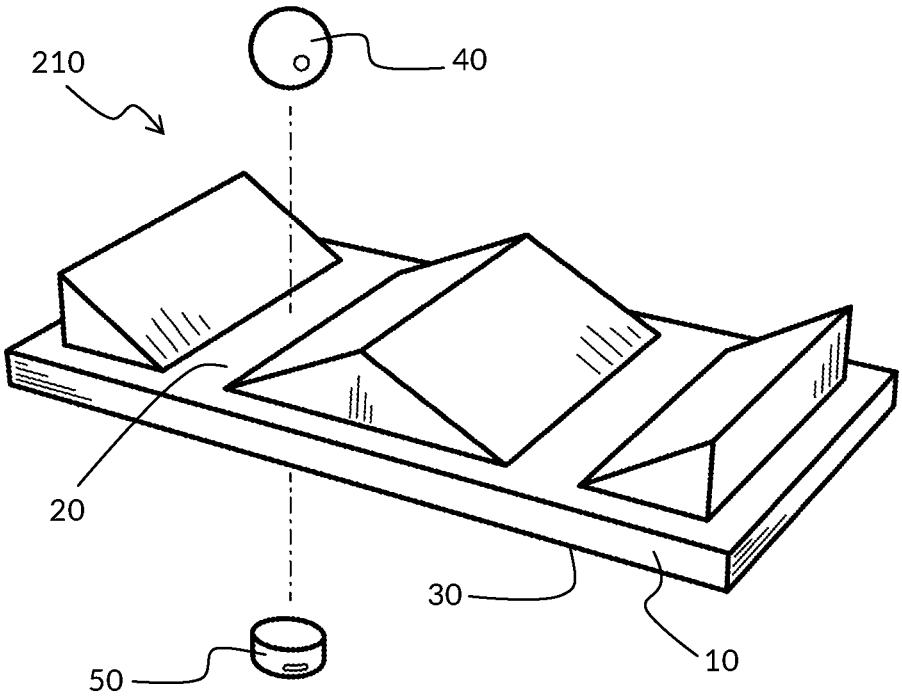
FIG. 2A is a perspective view of an embodiment of the present disclosure, showing a fidget walker device 210 that emulates haptic and acoustic feedback from a toggle switch.

FIG. 2A shows one embodiment of the present disclosure, a fidget walker device 210 that emulates haptic and acoustic feedback from a mechanical toggle switch. This is one of the simplest embodiments. The device comprises three components: a plate 10, an escorted item 40, and a control peg 50. Plate 10 comprises a rectangular platform, with a substantially smooth and plain underside region 30 which is not visible in FIG. 2A. Plate 10 comprises a substantially uneven and rugged surface terrain 20. Three distinct terrain features of this uneven surface terrain 20 can be observed in FIG. 2A, and will be described shortly. In this embodiment, escorted item 40 is a sphere neodymium magnet, control peg 50 is a disc neodymium magnet, and plate 10 is made of plastic, a non-magnetic material. Escorted item 40 rests on surface terrain 20, while control peg 50 is used under said underside region 30. Control peg 50 can be pushed up against underside region 30 and scooted around, since said underside region 30 is substantially smooth. When escorted item 40 is placed in proximity to control peg 50, such as depicted along the dashed lines, they are able to be magnetically coupled, even though they are separated by plate 10.

Figure 2B:
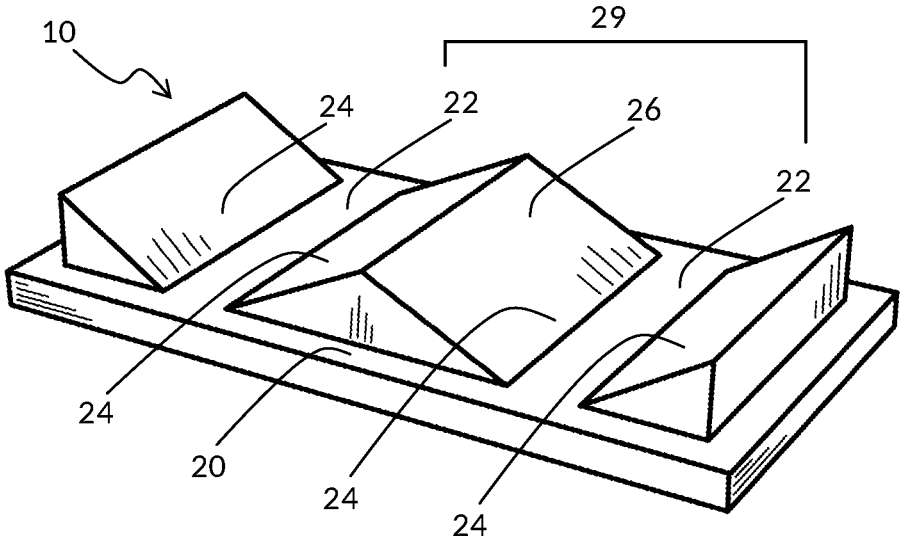
FIG. 2B is a perspective view of plate 10 and its surface terrain 20 from FIG. 2A, showing various terrain features including valleys 22, slopes 24 and hill 26.

FIG. 2B is a perspective view of plate 10 and its substantially uneven surface terrain 20 of the same embodiment, showing various terrain features. Enumerating these terrain features from left to right, we have: a downslope 24, a valley 22, an upslope 24, a hill 26, another downslope 24, another valley 22, and finally the last upslope 24 on the far right. These features overlap with one another in space. For instance, hill 26 comprises a large part of an upslope 24 and a large part of a downslope 24. For instance, valley 22 comprises a small part of a downslope 24 and a small part of an upslope 24. A label such as slope or upslope only serves to identify a particular portion of the greater surface terrain 20. As mentioned earlier, a control peg and an escorted item magnetically couple when placed in proximity. When said control peg is dragged around, the escorted item follows, climbing up and roll down hills. I define a group of two or more terrain features thus traveled by an escorted item as a terrain path. A terrain path does not need to cover the entirety of a surface terrain. For instance, in FIG. 2B, a terrain path 29 comprises two valleys 22 and one hill 26.

Figure 2C:
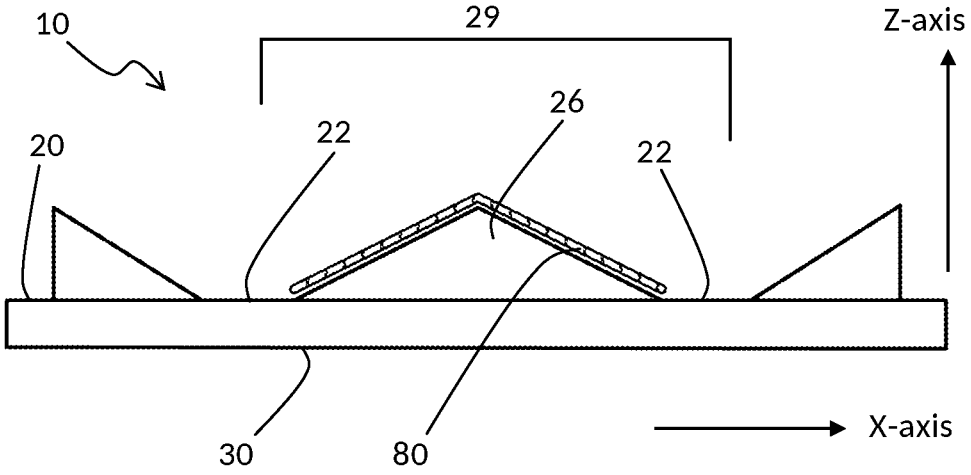
FIG. 2C is a front view of plate 10 and its surface terrain 20 from FIG. 2A, showing an elevation profile of a terrain feature, hill 26, in a Z-axis running perpendicular to the XY plane of underside region 30 of plate 10.

FIG. 2C is a front view of plate 10 and its surface terrain 20 of the same embodiment, showing an elevation profile of terrain features in a Z-axis running perpendicular to the XY plane of underside region 30 of plate 10. The XY plane and the Y axis are not visible in this front view. The X-axis runs across from left to right in this view. The Z-axis points straight up in this view, and is used to measure elevation of terrain features. In FIG. 2C, a feature profile 80 is indicated, showing changes in Z-axis elevation of hill 26 over a stretch of underside region 30 with respect to the X-axis. The profile is non-flat which is one of the characters of a terrain feature. For any given terrain feature, such as one of two valleys 22, a different feature profile may be drawn, given an orthographic projection view of plate 10, where the Z-axis points straight up. FIG. 2C illustrates a terrain path 29 comprising valleys 22 and hill 26.

Figure 2D:
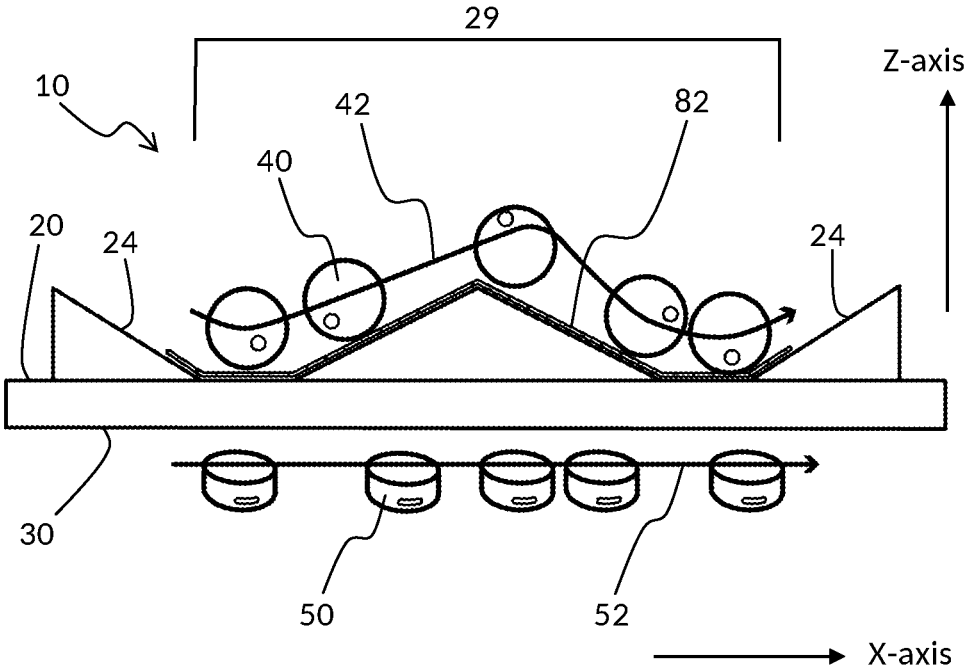
FIG. 2D is the same front view from FIG. 2C, showing escorted trajectory 42 of escorted item 40 over path profile 82 of terrain path 29, when dragged by control peg 50 moving in a control trajectory 52.

FIG. 2D is the same front view of the same plate 10 and its surface terrain 20 and the same terrain path 29. A path profile 82 is indicated, showing changes in Z-axis elevation of terrain path 29 over a stretch of underside region 30 with respect to the X-axis. A control peg 50 is shown moving in a substantially straight manner over the X-axis from left to right. The center of mass of control peg 50 traces a control trajectory 52. An escorted item 40 is magnetically-coupled to the control peg 50, and is dragged by control peg 50 across the terrain path 29 without losing magnetic coupling. The center of mass of the escorted item 40 traces an escorted trajectory 42, which is similar in shape to the path profile 82, but not identical. For instance, at the top of the hill of terrain path 29, escorted item 40 jumps into the air briefly before landing on a downslope. On the other hand, the profile of the escorted trajectory 42 in Z-axis is substantially different from that of the control trajectory 52. The changes in distance between escorted item 40 and control peg 50 translate to changes in the strength of the magnetic coupling between them, generating both tactile and haptic feedback on hand and fingers, when plate 10 is held by a hand, and control peg 50 is moved by a finger or a thumb.

Actual escorted trajectory 42 will vary depending on many factors, including materials and shapes of escorted item 40, control peg 50, terrain path 29 and plate 10. The strength of magnetism, thickness of plate 10, and how fast control peg 50 moves also affect the trajectory. In addition, an escorted item shaped as a cube or a disc may change orientation as well mid-travel, thus shifting its center of mass, further reshaping its escorted trajectory. The differences in escorted trajectory 42 and path profile 82 correlate with the production of various types of acoustic effects, as escorted item 40 rolls on, drags against, and collides with portions of terrain features in different ways.

In this embodiment as shown in FIG. 2D, surface terrain 20 and underside region 30 each takes up a substantial portion of the top face and the bottom face of plate 10, respectively. Thus escorted item 40 can be magnetically-dragged by control peg 50 to almost any point on surface terrain 20, as long as control peg 50 remains in proximity to underside region 30. Two slopes 24 bracket terrain path 29. They are useful as a means to signal end of terrain path to an operator.

Second Embodiment: Toggle Switch with Enclosure

Figure 2E:
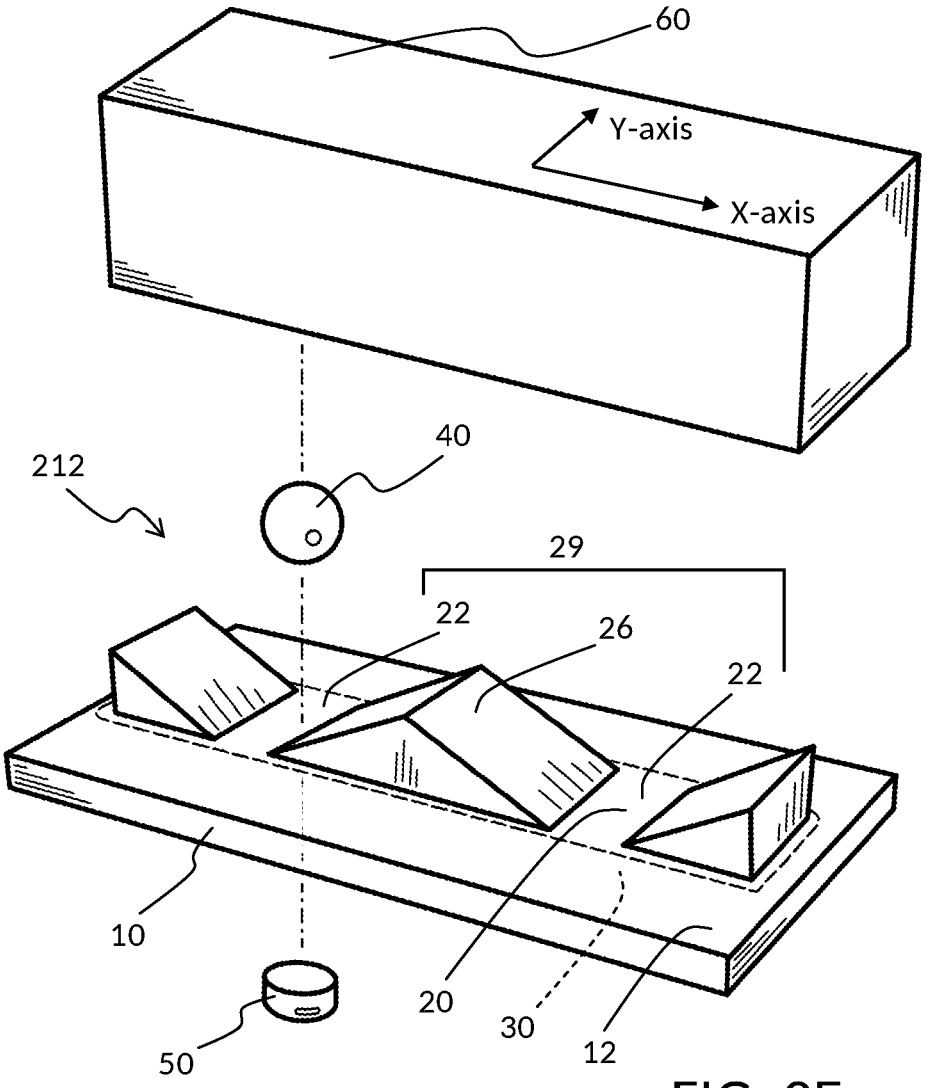
FIG. 2E is a perspective view of an embodiment similar to that from FIG. 2A, but the surface terrain 20 of fidget walker device 212 is capped with an enclosure 60.

FIG. 2E shows another embodiment of the present disclosure, a fidget walker device 212 emulating a mechanical toggle switch, with an enclosure. The device comprises four components: a plate 10, an escorted item 40, a control peg 50, and an enclosure 60. The enclosure 60 is made of plastic, a non-magnetic material. In this embodiment, both surface terrain 20 and underside region 30 cover only a portion of plate 10, as indicated by dashed lines around surface terrain 20. Underside region 30 is not directly visible in this view. A terrain path 29 of terrain surface 20 comprises two valleys 22 and one hill 26. Terrain path 29 is completely covered by an enclosure 60, confining an escorted item 40 between the enclosure 60 and terrain surface 20, even when the escorted item 40 is not magnetically bound through plate 10 to control peg 50. The enclosure 60 also confines the movement of escorted item 40 on the XY plane to be within the walls of the enclosure. The XY plane is defined by X-axis and Y-axis of the underside region 30, which happens to be coplanar with the top of enclosure 60 in this embodiment. The effective roaming range of control peg 50, where it can remain magnetically coupled to escorted item 40, is the underside region 30, with an area and a shape roughly matching that of surface terrain 20 denoted by said dashed lines. An outside space 12 on plate 10 lies outside surface terrain 20, and is unused in this embodiment.

The two valleys in FIG. 2E form two stable stops for escorted item 40. An operator moving a magnetically-coupled control peg 50 will feel a tangible inertial resistance, when trying to drag said escorted item 40 out of one of these two stable stops. Dragging escorted item 40 up towards hill 26 becomes easier once the escorted item 40 rolls uphill. The peak of hill 26 does not feel stable to fingers moving control peg 50. Due to magnetic attractions, escorted item 40 will spontaneously roll down one of the two sides of hill 26 at the peak. At such unstable spots, the causal relationship of dragging is reversed. Escorted item 40 will attempt to spontaneously drag control peg 50 towards one of the two valleys 22. This reversal of causal relationship translates magnetically into tactile and haptic feedback. These trick the mind into believing that it is operating a traditional toggle switch with a spring and a rocking mechanism.

to recap, escorted item 40 lags behind control peg 50 as it is dragged out of a valley, but leads control peg 50 when it rolls over the peak of hill 26, and as it dives into the other valley. This embodiment is designed explicitly with mellow slopes around a valley, so that when escorted item 40 hits the bottom of a valley, it doesn't simply stop dead. Instead, it overshoots, retracts, and then gets into a mad oscillating state, before it comes to a vibrating stop. The physical interactions of the escorted item 40 against surface terrain 20 generate not only magnetic sensations, but also acoustic noises that further enhances the sensation and the illusion of flipping a mechanical switch. Not all embodiments of a valley terrain feature need be thus created, however. In some applications, contact bounce or contact chatter can be reduced or removed by differently-designed valley shapes, by the use of different terrain materials, by coating an escorted item in a layer of rubber, etc.

Figure 2F:
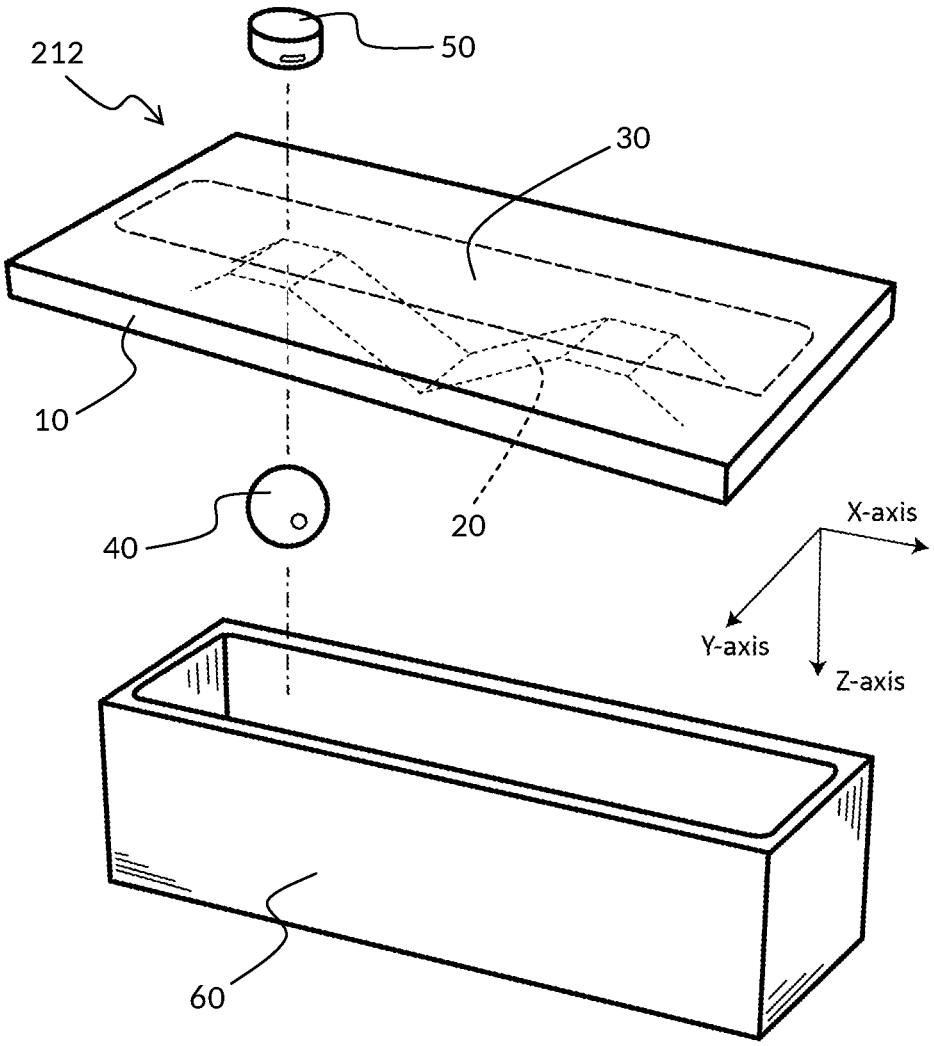
FIG. 2F is another perspective view of fidget walker device 212 from FIG. 2E, now flipped upside down to expose the underside region 30 of the plate 10.

FIG. 2F is another view of the same device 212 from FIG. 2E, now flipped upside down to expose the substantially smooth and plain underside region 30 of the plate 10. As mentioned, underside region 30 covers only a portion of plate 10. Its range is roughly equivalent to that of surface terrain 20, now on the other side of the plate, and thus not visible in this view. Unless otherwise specified, all axes references in the present disclosure are defined with respect to the undersize region 30. The X-axis and the Y-axis define the XY plane of said underside region 30. Z-axis runs perpendicular to the XY plane, and points toward the direction where escorted item 40 is found. In this embodiment, control peg 50 is a disc neodymium magnet, and escorted item 40 is a sphere neodymium magnet. The structure of enclosure 60 is clearly visible in this view, confirming its hollowed nature.

This fidget walker embodiment may be operated by a single hand, or by both hands. When singlehanded, a thumb would usually be employed to move control peg 50 within underside region 30. But other fingers may also be employed. When doublehanded, a finger or some fingers from a hand different from another one holding plate 10 would move control peg 50. Control peg 50 may take other shapes in order to enhance finger gripping, such as a cylinder, a bar, a miniature figurine, etc. Wherever appropriate, control peg 50 may be partially constrained such that it cannot be completely detached from underside region 30, while still retaining its ability to move within the same underside region 30. This prevents the loss of the control peg 50, when a fidget walker is not being used.

The toggle switch embodiment of a fidget walker in FIG. 2E and FIG. 2F highlights some of the key advantages of basic principles disclosed herein. It provides a novel sensory experience. An operator haptically and acoustically feels that a toggle switch is being flipped, but all a finger did was to scoot about with a disc magnet. It is simple in design, easy to manufacture, and can be mass-produced at low cost. Fidget walker 212 comprises just four components. Two of these are cheap, off-the-shelf magnets that require no post-processing. The rest two components can be stamped out by ordinary injection molding at scale. Yet this fidget walker produces haptic and acoustic feedback that some users claim to be more powerful and more realistic than the real thing.

As mentioned already, many embodiments of the present disclosure are amenable to be combined with additional parts, to serve new purposes outside the fidget toy domain. For instance, only a few additional mechanical parts and electronic sensors are needed, to turn fidget walker 212 in FIG. 2E into a bona fide underwater switch, or a magnetic lock. Elaborate and expensive waterproofing furnishing is not required, because escorted item 40 and internal machineries are already intrinsically shielded from control peg 50 by plate 10. Similarly, an underwater push-button, a type of biased switch, can be inexpensively created by raising one valley of device 2021 up, such that it is no longer a stable stop.

Third Embodiment: Toggle Switch with Enclosure and Peg Clip

Figure 2G:
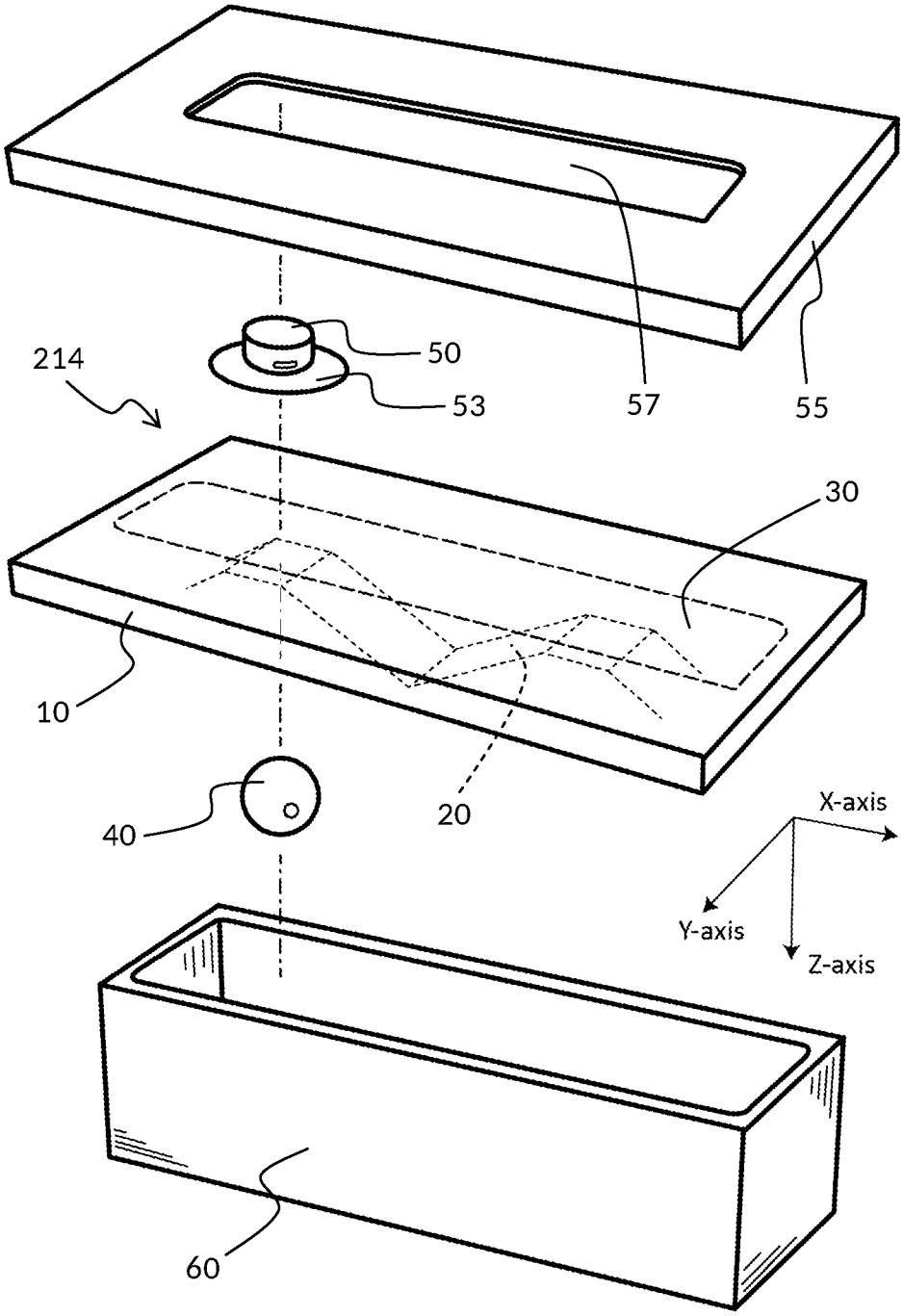
FIG. 2G is a perspective view of an embodiment, fidget walker device 214, that incorporates additional parts including peg brim 53 and peg clip 55 which are compatible with fidget walker device 212 from FIG. 2F.

FIG. 2G shows yet another embodiment of the present disclosure, a fidget walker device 214 emulating a mechanical toggle switch, with an enclosure, and with two additional non-magnetic parts: peg brim 53 and peg clip 55, both made of plastic, and are compatible dimension-wise with fidget walker device 212 from FIG. 2F. The perspective view in FIG. 2G has plate 10 flipped upside down, unlike most illustrations in the present disclosure. As a result, the Z-axis of the XY plane of underside region 30 points downward, and the substantially smooth and plain underside region 30 is visible in this view. An enclosure 60 confines escorted item 40 to travel on surface terrain 20, when escorted item 40 is coupled to control peg 50. A thin peg brim 53 is permanently attached to control peg 50, like a brim to the crown of a hat. A peg clip 55 is removably-attachable to plate 10, to retain control peg 50, and to confine it to underside region 30, via peg brim 53 of control peg 50. Peg clip 55 has a slot 57 cut out in its center, to allow control peg to poke through, but with a width too narrow to let peg brim 53 through.

Figure 2H:
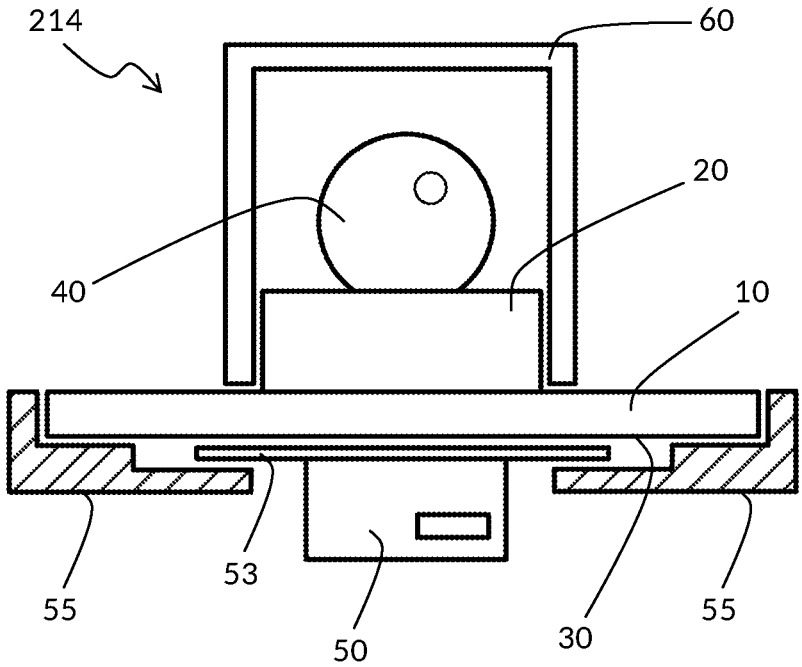
FIG. 2H is a cross-sectional view of fidget walker device 214 showing enclosure 60 and peg clip 55 attached to plate 10, to keep escorted item 40 inside the enclosure 60, and control peg 50 retained and constrained to underside region 30.

FIG. 2H shows a cross-sectional view of the same embodiment, fidget walker device 214, where all parts and components are assembled and attached. Enclosure 60 is attached to surface terrain 20 and plate 10, trapping escorted item 40 inside. Peg clip 55 is attached to plate 10, retaining control peg 50 via its peg brim 53 to the underside region 30. Escorted item 40 can freely move about within the confinement of enclosure 60, when not magnetically coupled to control peg 50. However, control peg 50 can only move on the plane XY of underside region 30, within boundaries set by the center slot of peg clip 55.

Fidget walker device 214 illustrates one way to retain control peg 50, while allowing it necessary movements to operate the device. Peg brim 53 and peg clip 55 in this embodiment are designed to fit device 212. Thus device 212 can be operated with a free disc magnet, or optionally customized with a brimmed magnet and a peg clip, turning into device 214. Other mechanisms exist to achieve the same retaining function. For instance, control peg 50 may be tethered by a string to plate 10. Or a recess on the device can be created such that control peg 50 may be stored at the recess, without creating a protrusion on the device. This recess may be designed such that when control peg 50 is placed in the recess, the escorted item 40 is magnetically coupled to it, prevent escorted item 40 from making noises when the fidget walker is carried.

Figure 2L:
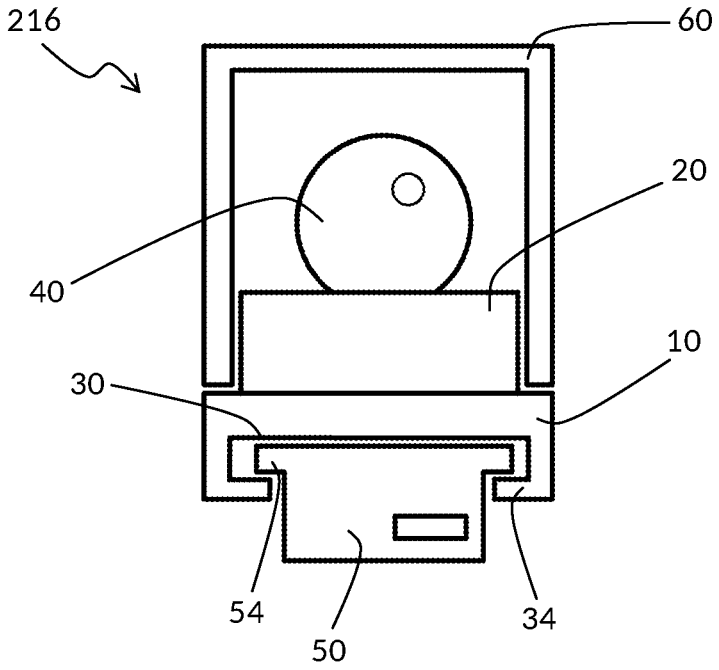
FIG. 2L is a cross-sectional view of fidget walker device 216 where underside region 30 is flanked by two hooks 34, forming a T-slot to receive a control peg 50 in the shape of a T-slide with flange 54.

FIG. 2L shows a cross-sectional view of a fidget walker device 216 with a different mechanism to retain control peg 50. In this device, control peg 50 is flanged, with two protrusions 54 on its two sides. Thus, flanged control peg 50 takes the shape of a typical T-slide. Plate 10 comprises underside region 30 flanked by two hooks 34 on its two sides. Thus, plate 10 takes the shape of a T-slot. Control peg 50 can be inserted into the T-slot with sufficient gaps on all sides, such that control peg can freely slide within the T-slot.

Figure 2M:
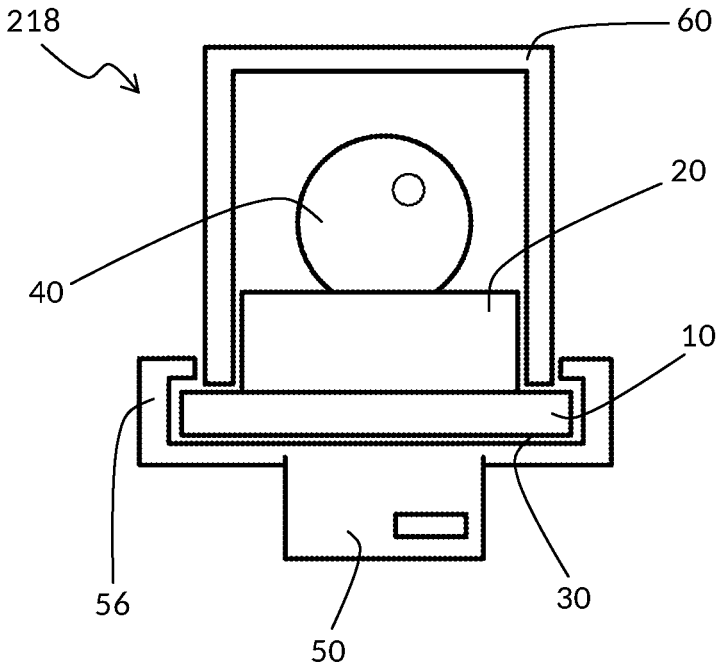
FIG. 2M is a cross-sectional view of fidget walker device 218 where control peg 50 comprises a disc magnet and two hooks 56 that snaps the magnet to plate 10, like a train to a suspended monorail.

FIG. 2M shows a cross-sectional view of yet another fidget walker device 218, with yet another mechanism to retain control peg 50. In this device, control peg 50 is flanked by two hooks 56 on its two sides, allowing control peg 50 to be snapped onto plate 10, like a train to a suspended monorail. There are sufficient gaps on all sides of plate 10, such that control peg 50 can freely slide on plate 10.

Fourth Embodiment: Discrete Dimmer

Figure 3A:
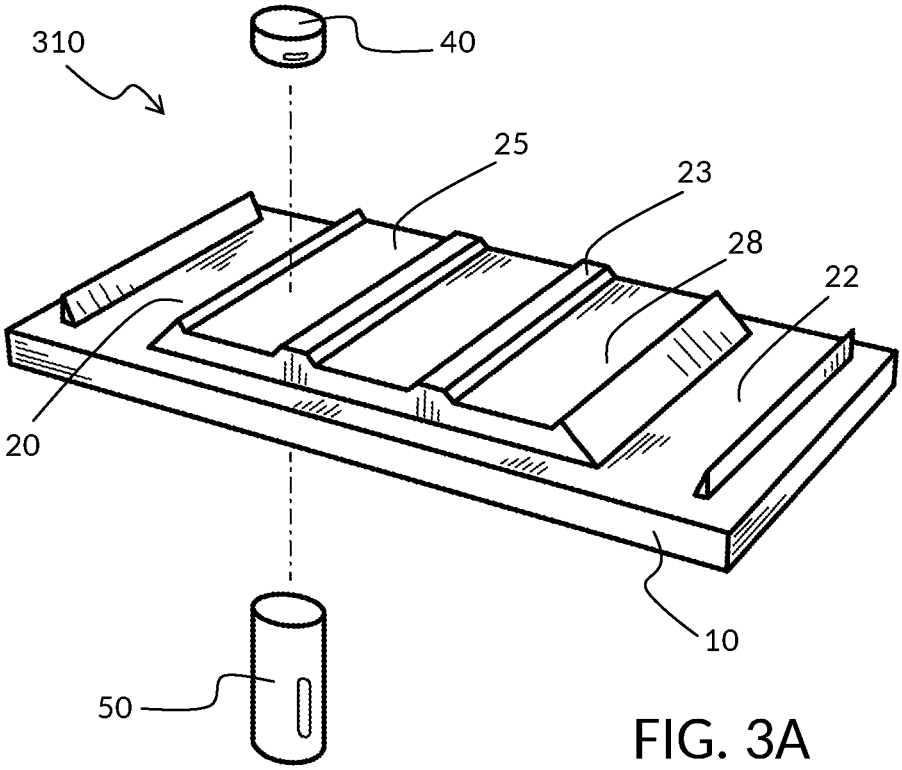
FIG. 3A is a perspective view of an embodiment of the present disclosure, showing a fidget walker device 310 that emulates haptic and acoustic feedback from a discrete slide control on a dimmer switch.

FIG. 3A shows one embodiment of the present disclosure, a fidget walker device 310 that emulates haptic and acoustic feedback from a dimmer switch with a discrete slider. Fidget walker 310 shares many similar characteristics as fidget walker 210 from FIG. 2A. However, a large plateau 28 takes up a substantial portion of surface terrain 20 of plate 10 of fidget walker 310 in FIG. 3A. Plateau 28 is bracketed by two valleys 22, with four bumps 23, evenly distributed over the plateau. These bumps create three trenches 25, each wide enough to accommodate an escorted item 40 which is a disc magnet in this embodiment. The two valleys 22 are also wide enough to accommodate escorted item 40. This creates a total of five stable stops for escorted item 40. An operator moving a magnetically-coupled cylinder control peg 50 will feel a tangible inertial resistance, when trying to drag said escorted item 40 out of one of these stable stops.

Figure 3B:
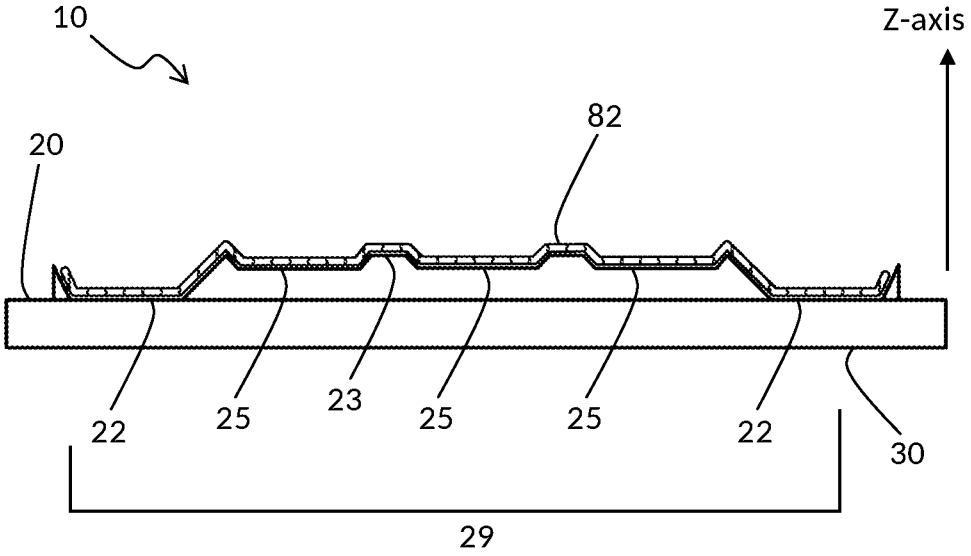
FIG. 3B is a front view of plate 10 and its surface terrain 20 from FIG. 3A, showing various terrain features including valleys 22, plateau 28, bumps 23 and trenches 25, as well as their elevation profile in a Z-axis running perpendicular to the XY plane of underside region 30 of plate 10.

FIG. 3B is a front view of plate 10 and its surface terrain 20 of the same embodiment, showing path profile 82 of terrain path 29. The two valleys 22 at the two ends of terrain path 29 are significantly lower in Z-axis, and thus closer to underside region 30, when compared to the three trenches 25 bracketed by bumps 23. An escorted item situated at a valley 22 therefore feels more stable than any of the three trenches 25, due to stronger magnetic coupling. This maps well to a discrete dimmer switch, where the OFF and the FULL-ON positions at the two ends of the dimmer generate more satisfying clicking sensation than intermediate stops.

Fifth Embodiment: Discrete Dimmer with Enclosure

Figure 3C:
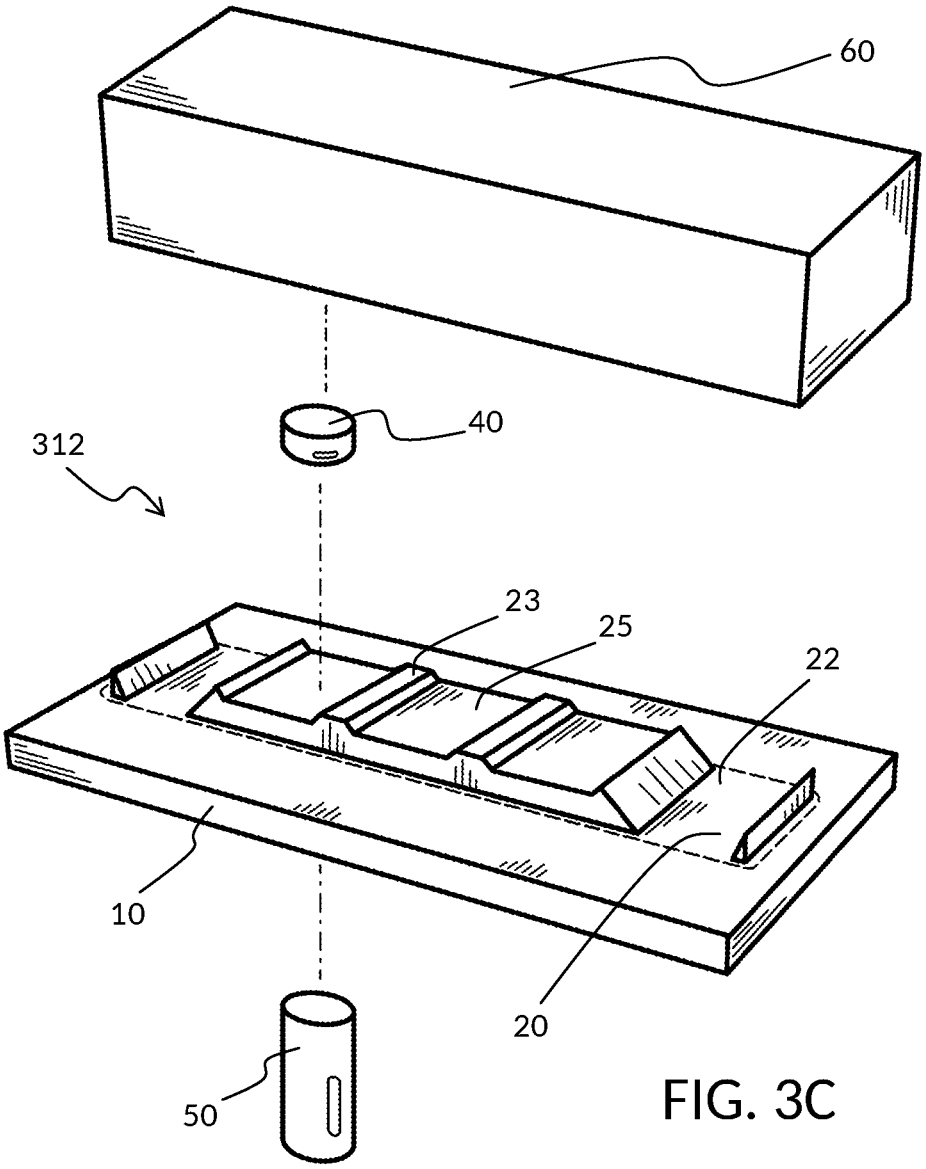
FIG. 3C is a perspective view of an embodiment similar to that from FIG. 3A, but surface terrain 20 of fidget walker device 312 is capped with an enclosure 60.

FIG. 3C shows another embodiment of the present disclosure, a fidget walker device 312 emulating a discrete dimmer, with an enclosure 60. Four bumps 23, three trenches 25, and two valleys 22 form a graduated surface terrain 20 on plate 10. Enclosed fidget walkers with such graduated surface terrains are amenable to be turned into underwater or waterproof dimmer switches with additional parts, for use in swimming pools, hot tubs, showers, home aquariums, remote-controlled boats, real boats, and outdoor equipment. For different applications, escorted item 40 and control peg 50 can be reshaped according to quired underwater needs.

Graduated surface terrains can also be used to create magnetic combination locks. For instance, three strips of graduated surface terrains may be provisioned on a single shared plate. A single control peg may be used to select a position in each strip successively. Or one control peg may be provisioned for each strip. If each surface terrain is provided with 10 stable stops, then a magnetic combination lock with 10^3, or 1,000 combinations is created. In this case, the lock may be thought of as three fidget walker 312 chained in tandem. Their plates happen to be merged into a single plate. Adopting such three-strip fidget walker device is a straightforward process for one skilled in the art. Levers, springs, pistons and other traditional mechanical parts can be wired and positioned to be influenced by escorted items or control pegs, thus releasing a lock only when all three strips have an escorted item located at predesignated stable stops. These are routine adaptations for a person skilled in the art of lock design.

Sixth Embodiment: Ratchet

Figure 4A:
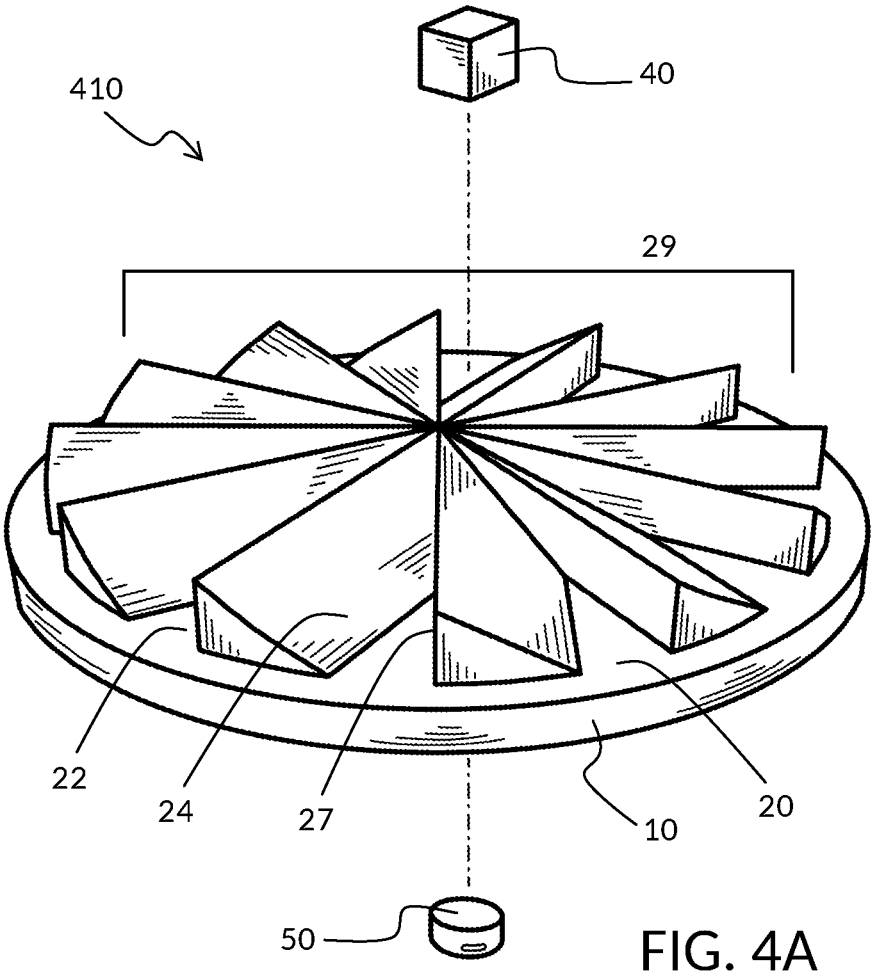
FIG. 4A is a perspective view of an embodiment of the present disclosure, showing a fidget walker device 410 that emulates haptic and acoustic feedback from a ratchet wrench, or a percussive ratchet instrument known as a cog rattle. Surface terrain 20 of device 410 includes twelve teeth each formed by a valley 22, a slope 24 and a cliff 27.

FIG. 4A shows another embodiment of the present disclosure, a fidget walker device 410 emulating a ratchet wrench, or a percussive ratchet instrument known as a cog rattle. The device comprises three components: a plate 10, an escorted item 40, and a control peg 50. Plate 10 comprises a circular platform, with a substantially smooth and plain underside region which is not visible in FIG. 4A. A substantially uneven and rugged surface terrain 20 covers the majority of the top face of plate 10. Surface terrain 20 comprises twelve asymmetrical teeth, each comprising three terrain features: a valley 22, an upslope 24, and a cliff 27 with a sheer vertical drop. The twelve asymmetrical teeth are evenly distributed forming a concentric circle around the center of the circular platform, not unlike hour marks on a clock, or blades in a fan. The twelve teeth thus oriented and positions form a terrain path 29 in the shape of a loop. Escorted item 40 is a cube neodymium magnet in this embodiment. Its square edges and pointy corners allow it to fit well whether it is closer to the center, or to the edge of plate 10. Control peg 50 is a flat disc neodymium magnet, allowing for single-handed operations. That is, when a hand holds plate 10, its thumb alone is enough to operate control peg 50.

This simple fidget walker can be made very small, with plate 10 injection-molded in plastic, with roughly the dimensions of a casino coin chip. As mentioned, it can be held in the palm of a hand, and operated with a thumb alone. Such a small device, however, can generate an unproportionally loud and clear ratcheting sound, mimicking a cog rattle, a percussion instrument. One circle of control peg movement generates twelve loud clicks. Variations of this embodiment can be made to produce slightly muted sounds while still delivering satisfactory haptic feedback, in order to emulate a ratchet wrench instead. This may be achieved by using different plate materials, using a plain steel ball instead of a cube magnet, coating the escorted item in silicone, etc.

The asymmetrical shape of each teeth makes it easy for escorted cube magnet 40 in FIG. 4A to be dragged clockwise, w.r.t. to this particular viewpoint. If an operator attempts to drag the cube magnet 40 counterclockwise, the cube magnet will often get stuck at the vertical face of a cliff. This embodiment demonstrates a terrain path that only works one-way, like a ratchet wrench, and unlike previous embodiments presented in this disclosure. The one-way nature of terrain path 29 is a feature rather than a bug in this design, as the path forms a loop. An operator can continue dragging escorted item 40 indefinitely with control peg 50, rolling in only one direction, and tracing an infinite escorted trajectory.

Seventh Embodiment: Ratchet with Enclosure

Figure 4B:
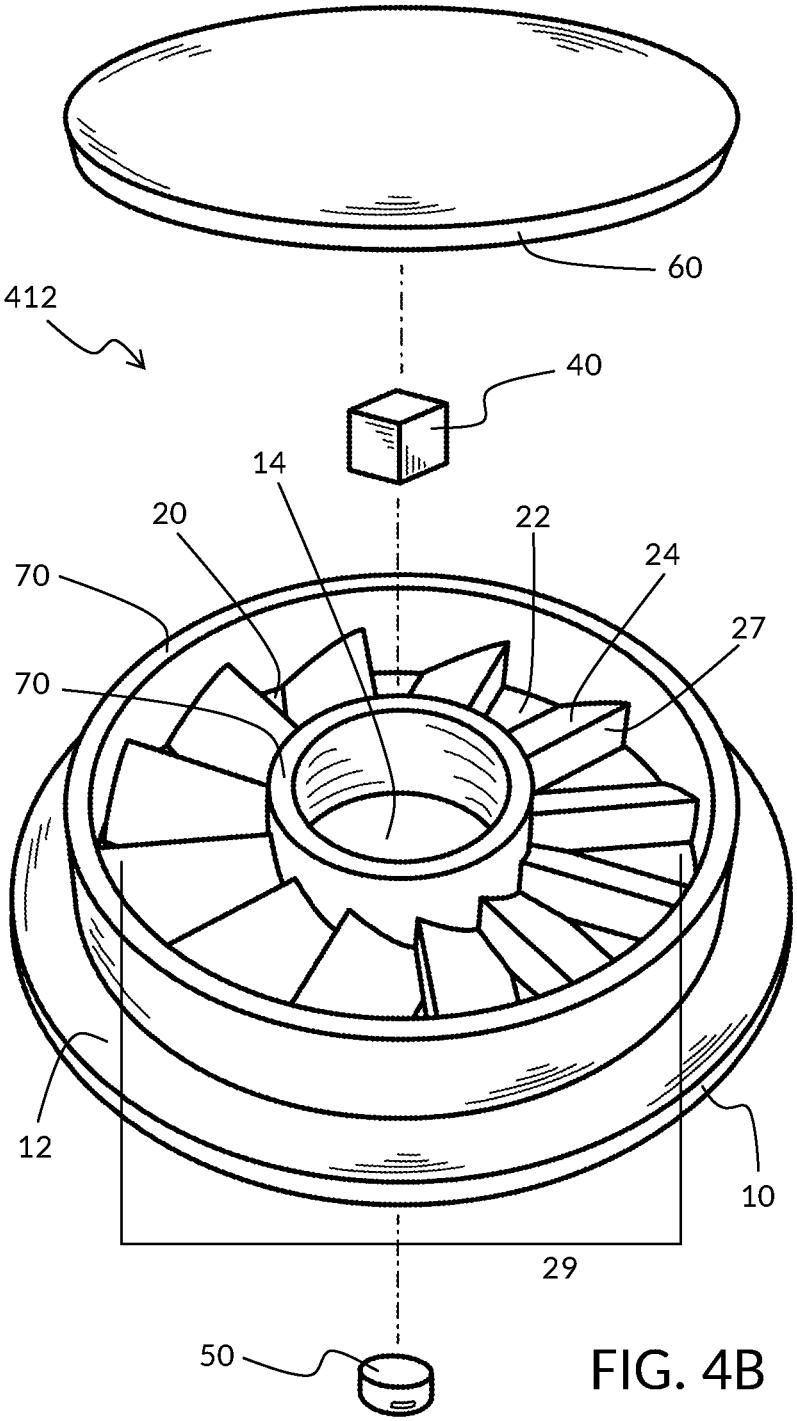
FIG. 4B is a perspective view of an embodiment similar to that from FIG. 4A, but the terrain path 29 of fidget walker device 412 is confined by guardrails 70 in this embodiment, and capped with an enclosure 60.

FIG. 4B shows another embodiment of the present disclosure, a fidget walker device 412 emulating a ratchet, with two guardrails 70, and an enclosure 60. Unlike previous embodiments with an enclosure, this embodiment employs enclosure 60 to provide only a top cover. Enclosure 60 does not include walls to prevent escorted item 40 from leaving surface terrain 20 sideways. The responsibility of guarding sideway motions of escorted item 40 is taken up by two concentric guardrails 70 instead, built into surface terrain 20. This surface terrain 20 does not covers the center portion of plate 10, unlike in previous embodiments. There is a center space 14 in the form of a hole separated from surface terrain 20, by the inner guardrail 70. In topological terms, surface terrain 20 is no longer a simply-connected space. Neither center space 14 nor outside space 12 hosts any terrain features, as these two spaces are inaccessible to escorted item 40 whose movement is limited to within the walls of the two guardrails 70. Surface terrain 20 comprises twelve asymmetrical teeth, each comprising three terrain features: a valley 22, an upslope 24, and a cliff 27 with a sheer vertical drop. The twelve teeth form a terrain path 29 in the shape of a loop. Shapes of teeth in fidget walker 412 have changed and no longer meet at the center of plate 10, due to the hole 14, in comparison to fidget walker 410. The entire plate 10 in device 412 looks like a ducted fan, and can be easily injection-molded like many other previous embodiments.

Figure 4C:
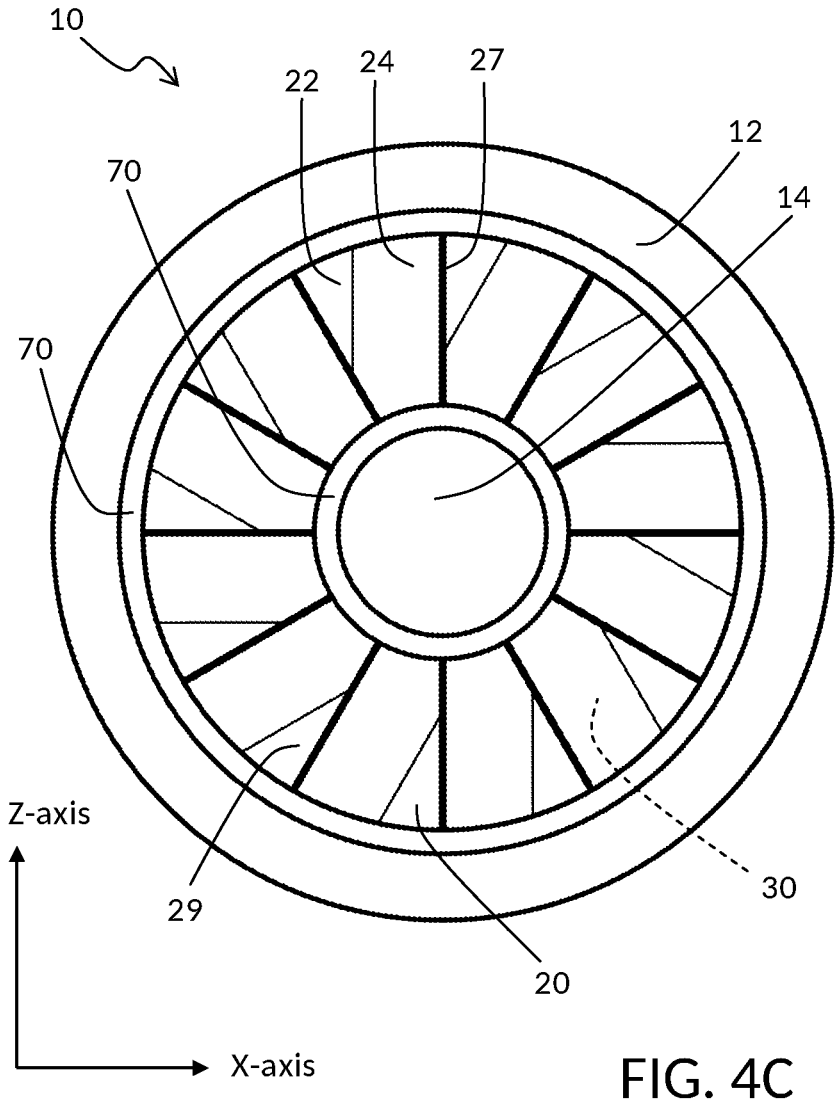
FIG. 4C is a top plan view of plate 10 and its surface terrain 20 from FIG. 4B, showing twelve teeth each formed by a valley 22, a slope 24 and a cliff 27, with X-axis and Y-axis of the XY plane of the underside region (not visible) indicated in the illustration.

FIG. 4C is a top plan view of plate 10 and its surface terrain 20 from FIG. 4B, showing twelve teeth each formed by a valley 22, a slope 24 and a cliff 27, with X-axis and Y-axis of the XY plane of the underside region 30 (not visible) indicated in the illustration. Both inner and outer guardrails 70 can be observed as concentric rings around the center of plate 10, separating the terrain path loop 29 from center space 14 and outside space 12. It can be thus observed that the two guardrails 70 physically constrain the movement of an escorted item in the X-axis and the Y-axis of the underside region 30, to said terrain path 29. When dragged by a free-moving control peg, an escorted item could end up tracing an escorted trajectory that deviates substantially from the control trajectory, in the X-axis and the Y-axis, as it is dragged against guardrail walls. Such deviation from the control trajectory can be sustained, as long as the item and the peg continue to be bound by magnetic coupling, even as the control peg ventures momentarily out of its underside region.

Most descriptions of operations of fidget walker 410 apply also to fidget walker 412, including its compact size, its one-way loop creating an infinite escorted trajectory, its use as a percussion instrument cog rattle, and its emulation of a ratchet wrench. The compact nature and the simple manufacturing requirement of device 412 enable creative derivations. Similar in spirit to the multi-strip application of a discreet dimmer device 312, multiple ratchet devices 412 can be used in tandem, to create a new type of percussion instrument. Multiple concentric, ratchet-like terrain paths can be provided on a shared circular plate, each path with a different type of ratchet teeth, for different haptic and acoustic experiences. Teeth do not all need to be evenly distributed, and that creates varied ratcheting patterns. A percussionist may hold a number of these compact ratchet devices in hands, each device with multiple path rings. The percussionist can thus play the most opportune ring or rings at any given moment in a performance, with this ensemble of ratchets. This multi-path ratchet instrument may also form the basis for a magnetic combination dial of a safe, with the same haptic and acoustic feedback afforded by a traditional mechanical dial.

Eighth Embodiment: Shift Stick

Figure 1B:
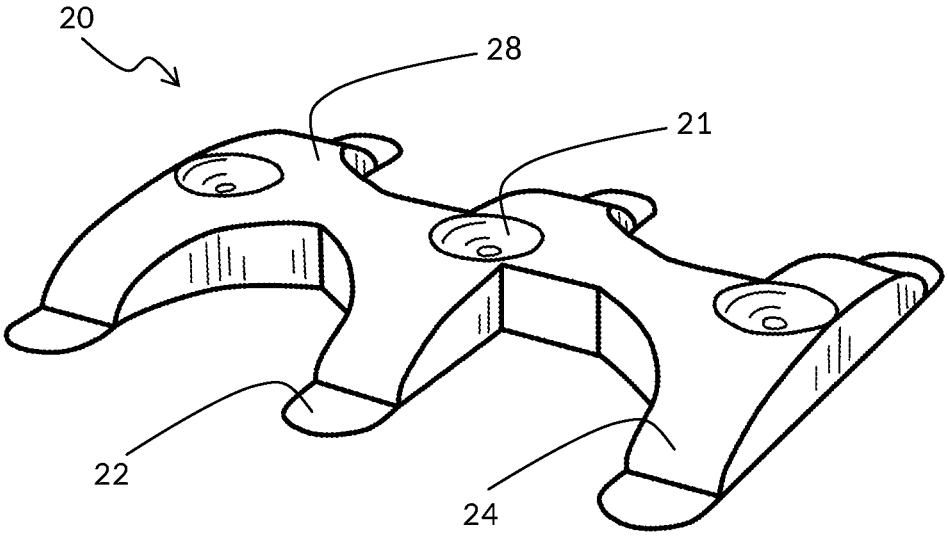
FIG. 1B is a perspective view of surface terrain 20 of fidget walker 110 from FIG. 1A, showing various terrain features including a horizontal plateau 28, three midpoint depressions 21, six endpoint valleys 22, and six upslopes 24 leading out of each valley.
Figure 1C:
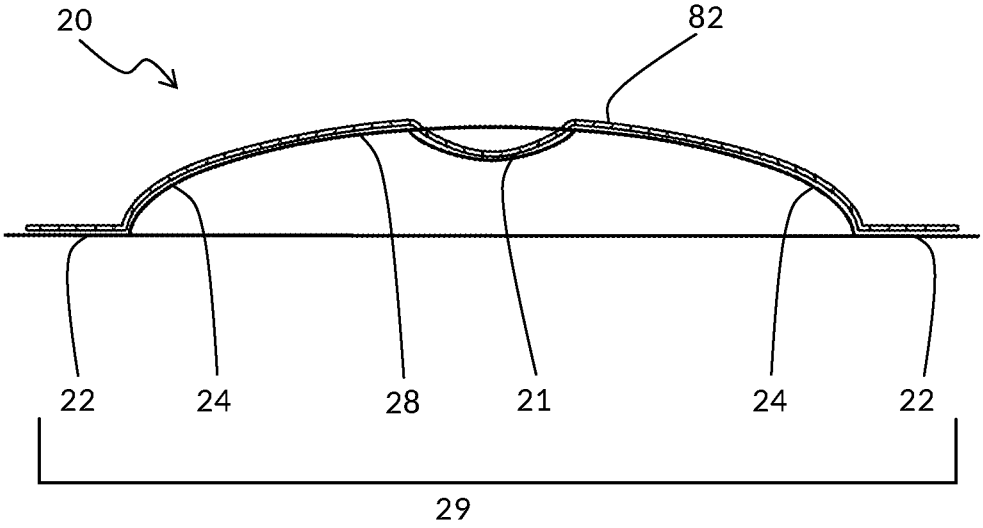
FIG. 1C is a right-side view of surface terrain 20 from FIG. 1B, showing an elevation of terrain features.
Figure 1D:
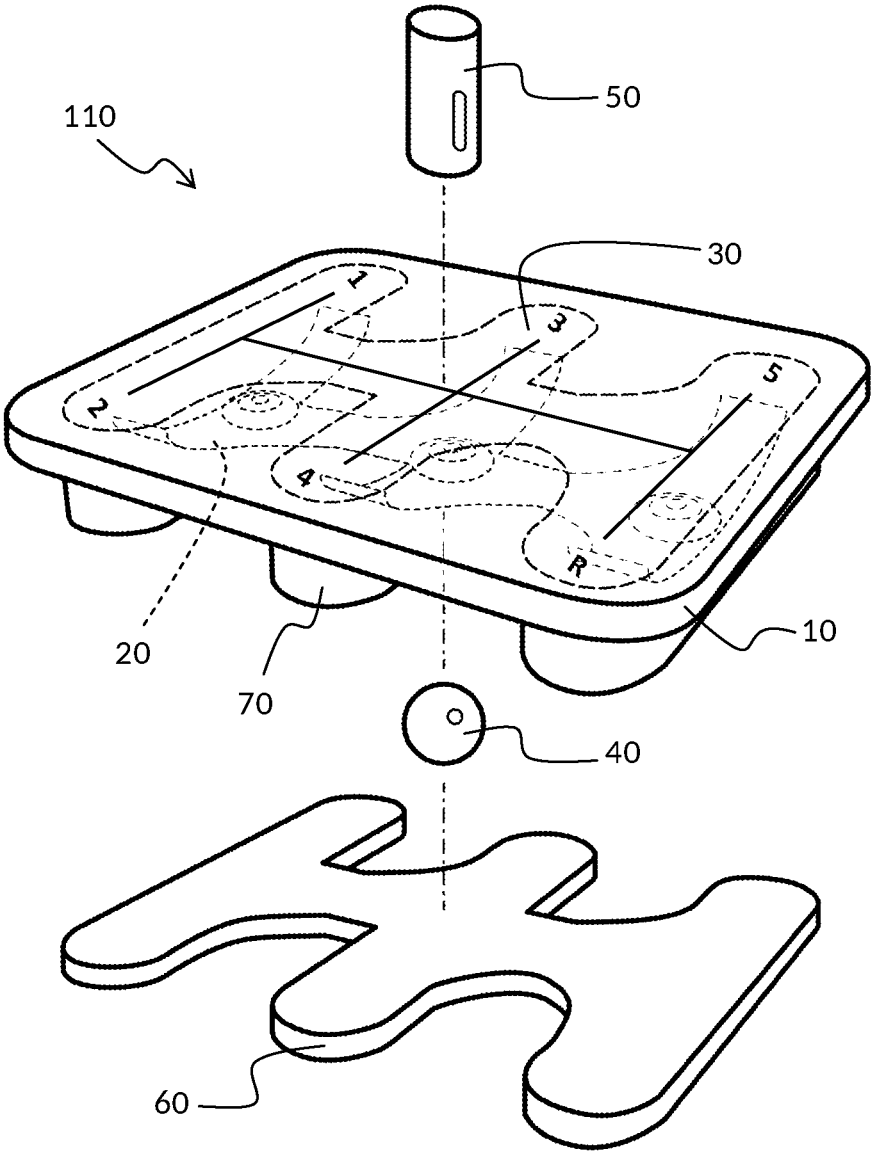
FIG. 1D is another perspective view of fidget walker device 110 from FIG. 1A, now flipped upside down to expose the underside region 30 of the plate 10. This device is clearly recognizable in this illustration as a miniature fidget emulation of a shift stick in a 5-gear manual transmission vehicle, as shown in FIG. 1E.
Figure 1E:
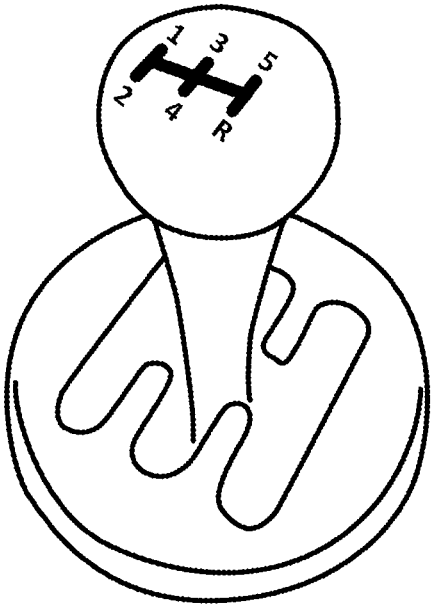
FIG. 1E depicts a typical shift stick in a 5-gear manual transmission vehicle.

FIG. 1A shows an embodiment of the present disclosure, a fidget walker device 110 that emulates haptic and acoustic feedback from a shift stick in a 5-gear manual transmission vehicle, depictured in FIG. 1E. There is a total of seven labeled gear positions in a 5-gear shift: neutral, 1st gear, 2nd gear, 3rd gear, 4th gear, 5th gear, and reverse. Six positions are reachable starting from the neutral position at the center of the shift pattern. The surface terrain 20 comprises a complex HH shape which represents said shift pattern, with a horizontal trunk that branches upward at three locations on the trunk, with three corresponding downward branches. Plate 10 provides three portions on its top face: surface terrain 20, outside space 12, and a longwinded guardrail 70. Guardrail 70 surrounds the perimeter of the HH-shaped surface terrain 20, separating surface terrain 20 from outside space 12, and constraining the movement of an escorted item 40, in the X-axis and the Y-axis of the underside region 30, to said surface terrain 20. Escorted item 40 is a sphere neodymium magnet, and control peg 50 is a cylinder neodymium magnet. An enclosure 60 caps guardrail 70 to keep escorted item 40 within device 110.

FIG. 1B shows the surface terrain 20 of fidget walker 110 from FIG. 1A, highlighting various terrain features including a horizontal plateau 28, three midpoint depressions 21, six endpoint valleys 22, and six upslopes 24 leading out of each valley. Valleys 22 and depressions 21 are stable stops. The center depression 21 represents the neutral position. Each endpoint valley 22 represents one of the five gears, and the reverse position. There are many ways to define a terrain path in this embodiment. Any group of two or more overlapping terrain features from surface terrain 20 may constitute a terrain path, as long as an escorted item can be dragged from one end of the path to the other end. Typically, a gear shift movement consists of moving from one of the seven gear positions, to another. Thus a typical terrain path in device 110 consists of terrain features traveled by an escorted item, from one valley 22 to and from another valley 22, or the center depression 21.

FIG. 1C shows a right-side view of surface terrain 20 from FIG. 1B, highlighting the elevation profile of terrain features spanning the width of two endpoint valleys 22. Terrain path 29 indicates the set of terrain features traveled by an escorted item over path profile 82. These terrain features include two valleys 22, two slopes 24, one plateau 28, and a depression 21. This terrain path represents a gear shift from one gear to another gear, through the neutral position. That is, the path starts from a stable stop, through an intermediate stable stop, and ends at a third stable stop.

FIG. 1D is another view of the same device 110 from FIG. 1A, now flipped upside down to expose the substantially smooth and plain underside region 30 of the plate 10. Underside region 30 covers only a portion of plate 10. Its range is roughly equivalent to that of surface terrain 20, now on the other side of the plate, and thus shown in dashed hidden lines in this view. Enclosure 60 caps escorted item 40, a sphere neodymium magnet, within device 110. A cylinder neodymium magnet is used as control peg 50 to simulate a physical gear shift stick. Gear positions and shift pattern lines are thinly and shallowly inscribed on underside region 30, from the first to the fifth gear, with N for neutral in the center, and R for reverse on the lower-right corner. Compare these labeled gear positions to those illustrated in FIG. 1E.

In this embodiment, guardrail 70 skirts the perimeter of surface terrain 20. But this is not a requirement in all embodiments. In an alternative embodiment of a shift stick, there may be a guardrail wall in between the fifth gear position and the reverse position, to prevent an escorted item from travelling directly between them. In yet another alternative embodiment, the auto-center behavior of modern gear shift boxes can be emulated in a fidget walker, by replacing the center depression of device 110 with a deep valley instead. Then corresponding connection terrains between this center valley and all other stable stops can be reshaped to facilitating auto-centering accordingly.

Device 110 and its variations are also useful outside fidget toys. For instance, they may become a part of a cheap and effective input device for driving simulation games running on smartphones or portable game consoles. Mobile games often have gamers provide input on-screen using their thumbs and other fingers. Many gamers find the lack of tactile and haptic feedback on mobile games unsatisfying. An input attachment to a smartphone can be created by simple injection molding, where the attachment is held by two hands. It may house a fidget walker push-button for clutch input, a fidget walker shift stick for gear shifts, and more fidget walker devices for gas pedal, brake, etc.

Alternative Embodiments

While this disclosure is susceptible to various modifications and alternative constructions, certain illustrative embodiments are shown in the drawings and are described in detail. It should be understood, therefore, that there is no intention to limit the disclosure to the specific embodiments disclosed, but on the contrary, the intention is to cover all modifications, alternative constructions, combinations, and equivalents falling within the spirit and scope of the disclosure.

A person skilled in the art will understand that further changes can be made to embodiments described, and still achieve desired results. It is also apparent that different combination of features described in selected embodiments can produce similar advantages and benefits. In some cases, a subset of these features can still produce the same advantages and benefits, and may even be desirable in certain use cases. All of above are a part of the present disclosure.

In detailed descriptions of illustrated embodiments, neodymium magnets in various forms are used to describe escorted items and control pegs, only for convenience. Any magnetically-attractable material may be used, including iron, steel, electric coils, etc. That is, they can be permanently magnetic, temporarily magnetic, or electromagnetic. Furthermore, both escorted items and control pegs may take any shape, as is convenient and appropriate. Not all portions of escorted items and control pegs need be magnetically attractable. Some portions of them may be non-magnetically attractable, as long as the magnetically-attractable portions continue to function as intended. If desired, coatings and other forms of sound retardation may be used to mute acoustic effects Parts and components other than escorted items and control pegs are usually made of non-magnetic materials. Embodiments in the present disclosure chiefly employ plastic as a cheap- and easily-to-manufacture option. But other non-magnetic materials may be used for alternative haptic and acoustic results, including: non-magnetic stainless steel, brass, rubber and wood. These parts and components may be injection-molded, die-cast, forged, CNC-milled, 3D-printed, or otherwise manufactured. Different materials affect the type and quality of haptic and acoustic feedback. If desired, paddings, foams, coatings and sound insulations may be used on surface terrains to mute acoustic effects.

Terrain features illustrated in some embodiments employ relatively simple geometric primitives such as slopes, spherical depressions, etc., for simplicity and clarity of disclosure. In actual productions, terrain features may have complex and intricate shapes, and may provide textured surfaces for alternative friction behavior when coming into contact with an escorted item, including random textures to increase friction and audio effects against a spherical magnet, and streamlined rails to reduce friction effects against a disc magnet.

Illustrated embodiments largely treat the movement of an escorted item as a simple trajectory in space, for simplicity and clarity of disclosure. In reality, different materials and shapes of an escorted item cause it to roll, tumble, change direction and somersault, as it is dragged by a control peg, or as it leads a control peg. These add variety to haptic and acoustic experiences.

Illustrated embodiments use surface terrains to affect the change in Z-axis of escorted trajectories, and enclosures or guardrails to constraint movements of escorted trajectories in the XY plane, for simplicity and clarity of disclosure. In actual productions, these three dimensions need not be considered separately. The space available to an escorted item may be instead carved out of a solid block, as grooves or channels instead. These channels may twist and turn, in order to force for instance a cube magnet to change orientation as it travels.

Two fidget walker devices may share one enclosure. For instance, two plate 10 of device 212 in FIG. 2E may share an enclosure which provides only surrounding walls. That is, the second plate 10 is flipped upside down, and serves as the top cover of enclosure 60. In this configuration, there is a single enclosed space within the conjoined fidget walker. Thus only one escorted item is needed, for both fidget walkers to be operable. And only one fidget walker may be used at a time, in this configuration. Similarly, there can be a rectangular bar where every one of four rectangular faces hosts a fidget walker, each with its own distinct haptic and acoustic pattern.

A single fidget walker may be provisioned with customizable terrain features, to allow for different haptic experiences. These features may be added, removed or changed by manual tweaking of some parts of the device. An enclosure may be temporarily detached, so that a surface terrain can be modified. A device's terrain features may be slotted out from one side of its enclosure, and replaced with different ones. Or a terrain feature may be pivoted out of a terrain path, and an alternative terrain feature pivoted in to replace it. In the latter case, all available terrain options may be hidden inside the device itself, and the pivoting may be effectuated with a magnet that an operator holds. Perhaps the same control peg can be used to drag an escorted item, as well as effectuating customizations.

Multiple and different control pegs may be provisioned for one single fidget walker, in order to change the fidgeting experience. Unused control pegs may be snapped into its own recess that is built into the device itself. A peg clip may be temporarily detached from a fidget walker, in order for its control peg to be changed.

Multiple control pegs may be used simultaneously on a single fidget walker, with a single escorted item inside the device. This creates interesting behaviors that expands the haptic experience even further. On a simple toggle switch device 212 illustrated in FIG. 2F, two disc magnets may be used as two control pegs, where both magnets have the same north-south magnetic orientation. An operator may hold one disc magnet with each thumb. It is possible to magnetically couple the escorted item to one disc magnet, drag the escorted item over the hill, and then pass the escorted item to the other disc magnet, with an additional distinct thump generated when the pass is successful. In fact, the two same-orientation disc magnets may be forcefully-glued side by side into a single control peg, and moved by a single thumb. At any given moment, an escorted item will only be coupled to one of these two control pegs, and never to both. And the same distinct passing of escorted item is enacted at either end of device 212's terrain path.

If one of the two disc magnets from the above configuration is flipped upside down, such that the two disc magnets have opposite polarity orientations, then they will naturally stick to one another on an underside region. At any given moment, an escorted item will only be coupled to one of these two control pegs, and never to both. These two disc magnets may again be glued side by side into a single control peg, if desired. Moving this combined control peg now produces a different passing thump. When an escorted item is passed from one disc magnet to another at the pit of a valley, the escorted item now somersaults 180° in order to match the polarity of the receiving disc magnet. If the escorted item of device 212 in FIG. 2F is replaced with magnet of different shape, such as a cube, even more interesting haptic and acoustic behaviors ensue. Many more variations like these can be obtained with combinations of multiple escorted item and/or multiple control pegs.

A control peg in fact does not need to always have its north-south polarity pointing exactly in the direction of Z-axis, referencing FIG. 2F. A control peg with its north pointing at a perpendicular angle to the Z-axis works just as well, with a different haptic behavior. An extension of this is a control peg in the form of a wheel that can be rolled against underside region 30, and as it is rolled its magnetic orientation rotates with the wheel, such that its north polarity changes from pointing up the Z-axis to pointing down the Z-axis. This causes the escorted item to rotate in tandem with a slight latency, generating haptic variations.

Fidget walkers may be turned into assemblable building blocks, which allow an operator to string a number of them in a way such that a single control peg can be moved from one block through another into yet a third block, so on and so forth. If each block produces haptic and acoustic feedback for a letter of the alphabet in Morse code, then whole sentences may be sounded out loud by a simple movement of a control peg. These blocks may have open tunnels that allow a single escorted item to be dragged from blocks to blocks. Or they may each contain their own escorted items. Each block may also have Braille dots of corresponding letters embossed on it.

As already described earlier, guardrails may be placed within a surface terrain, creating what at a glance looks like a traditional magnet maze. However, at every corner or corridor in this maze, appropriate terrain paths can be designed to sound out a unique label for this section of the maze, using Morse code or otherwise. Such maze would be more easily accessible to blind operators.

The underside region is completely flat and smooth in illustrated embodiments, for simplicity and clarity of disclosure. In actual productions, a curved surface or other surface shapes may be employed, as long as the user experience of sliding a control peg against the underside region is unimpeded. In illustrated embodiments, the underside region is co-planar with the bottom face of a plate, and the underside region is usually a simple convex polygon. These are not requirements. For instance, the underside region 30 in FIG. 1D is an exception, in that its HH-shaped underside region has a non-convex shape, and it has shift labels and shift pattern lines lightly inscribed on the underside region. In actual productions, the non-convex HH shape may be counterbored into plate 10 as a shallow indentation, to function as a weak coercion mechanism, in order to keep a control peg sliding within its bounds.

The lagging and leading actions of an escorted item can be exploited to generate faster and more impactful contacts than typically considered possible with a thumb sliding a control peg. This exploitation can emulate drum beats and cymbal hits. For instance, a small drum membrane may be embedded inside a fidget walker with a sound chamber and bass reflex, with one or more magnets embedded on the membrane. This membrane may be made to move and vibrate, when an escorted item snaps into a valley with a strong vibrating effect as previously described. The snap induces a drum beat, while the vibration gives the beat a unique timbre quality. Similarly a small cymbal or a small gong can be housed in a fidget walker for similar use. Lastly, multiple fidget walker instruments may be housed on multiple faces of a single enclosure. This creates a percussion ensemble where a musician may operate any instruments with a mere sliding of a thumb, including washboard, maraca, rachet, drums, cymbals and gongs. A musician can move a control peg against any fidget walker on the ensemble, or instead move the ensemble enclosure against a control peg embedded on some other surface. This ensemble may have built-in electronic music player as well, to which a musician may beat along. Or the ensemble may be connected by wire or by Bluetooth to a smartphone, where not only can a musician beat alongside music played on the phone, but also use a control peg to communicate with the smartphone, to play or pause a song, and even to play a musical game where physical fidget walker operations influence the game play.

Fidget walkers do not require electricity to operate, when used with additional mechanical components to create a combination lock. For a multi-strip fidget walker combination lock, a key box may be created to house corresponding number of control pegs placed at the right locations. By sliding the key box on the surface of the combination lock back and forth, escorted items inside the lock will be dragged and aligned properly, thus releasing a latch. This key box does not quire electricity to operate. Furthermore, the lock and the key box may be designed so they can be re-configured with new combination numbers, when in an unlocked state. The same can be applied to multi-ring fidget walker combination dials. In this case the key is also a cylinder or a disc which can be placed concentrically with the underside region of the lock. The key cylinder is rotated for more than one round, and lined up by a pre-determined mark with the lock, to release it.

A key box thus created may be permanently-affixed to an immobile structure such as a cement block of a building. Activities requiring proof of physical presence such as treasure hunting games, geocaching challenges, or souvenir confirmations, etc. may be conducted by locking a prize redemption code in a fidget walker enclosure serving as a cryptex. A participant must physically reach a physical location in order to drag a fidget walker cryptex against a mounted key box in order to open the cryptex. Once unlocked, pins in the cryptex are scrambled, such that the key remains in secret, and the cryptex needs to be re-configured for use again.

The strength of magnetism can be used to create magnetic locks that cannot be deciphered by simply placing a magnetic field viewer film on the outside of a safe. Start with a three-ring ratchet combination lock previously disclosed. Vary the height of each tooth in a ring from close-to-floor, all the way to impossible-for-escorted-item-to-pass, on a scale from one for weakest, to ten for strongest. Choose a number to configure this ring with, say three (weak). Randomly pick an escorted magnet from a set with varying magnetic strengths, from extremely weak to extremely strong. Then find a control peg to match with this escorted item, from an assorted set with varying magnetic strengths, such that this particular pair of magnets can be dragged from the weakest tooth starting at one, through to only three, and no more. Repeat the same for the other two rings. A key box can now be created to house the three chosen control pegs, such that a circular sweep of this key box over said fidget walker ratchet will set all three escorted items at the right teeth. But no other key combination will. A magnet field scan of either the lock or the key alone cannot reveal the combination, as their designated coupling strength can only be measured together. The placement locations of control pegs inside this key box are irrelevant to unlocking. This methodology can be applied to all magnetic lock designs disclosed herein.

The same principles leveraging above selective magnet strength for an undecipherable lock can also be used to create new classes of tabletop games. Consider one specific embodiment of a game with two or more players, where one part of the game comprises a fidget walker ratchet ring with 12 teeth of increasing tooth height. There is an assortment of escorted items with magnetic strength of one through six. Same with control pegs. All escorted items look the same despite their varied magnetic strength. Same with control pegs. Given a random pair of an escorted item and a control peg drawn from these assortments, said escorted item can be dragged from tooth one to tooth twelve by said control peg, representing all possible sums of two dice. Each player draws 3 escorted items and 3 control pegs at the start of a game. A part of the gameplay involves players moving their playing pieces on a board similar to that from the game of Monopoly. Instead of throwing two dice for every move, said fidget walker is used. When it's player one's turn to move their playing piece, player one puts one of their three escorted items on the fidget walker. Then player two chooses one of their three control pegs, and attempts to drag the escorted item to a sum least favorable to player one. Once player two stops dragging, player one picks up the fidget walker, and finalizes the choice of sum by further attempting to drag said piece forward, to a sum most favorable to them. Used escorted item and control peg may be swapped between players, or returned to assortment piles and redrawn.

This simple replacement of two dice introduces novel and interesting twists to the gameplay. How each player moves in a round is no longer based on just random luck. Neither player knows definitely the strengths of their escorted items and control pegs. They may only test what they have at hand, and evaluate their relative strengths. Players must hide the results of their evaluations from their opponents. When an escorted item is dragged by a player to a sum of eight, it doesn't necessarily mean the escorted item and the control peg sum up to exactly a strength of eight. The player may choose to stop deliberately at eight, even though the escorted item could be dragged to a sum of nine, or more. Even if eight is the maximum sum achievable with a pair, the strength of the pair may be two-six, six-two, three-five, five-three, or four-four. These principles may be used with existing games, or applied to create whole new classes of games.

In some situations an operator finds that moving and rotating a hand-size fidget walker enclosure more convenient and comfortable, compared to locating, holding and using a tiny control peg. Consider one use case of a remotely-rechargeable shower radio. With fidget walker tech, the exterior of the radio may be completely devoid of mechanical switches and knobs, and instead can be designed with surface textures for better grabbing by soapy fingers. A simple storage station for the radio with various control pegs embedded at strategic locations can be affixed to a shower wall. A user picks up the radio, and drags it down against a particular control peg to turn it on. The user then aligns a dimple on the radio with a bump on the station, and turns the radio clockwise to increase the volume. Finally the user swipes the radio to the right against another control peg to switch to the next preset radio station. At every step, haptic and acoustic feedback confirm the requested operation. This is just one specific embodiment in a sea of new product classes made possible with fidget walkers tech.

As already described in details, a fidget walker may be used alone, by human operators, or incorporated into automated machineries. A fidget walker may be combined with other mechanical or electric parts, to form new classes of devices. While fidget walkers can be used alone as a new class of fidget toy, it is widely applicable in many fields including but not limited to percussion instruments, underwater switches, magnetic locks, tabletop games, and automated machineries. All of these uses are a part of the present disclosure.

The invention claimed is:

1. A haptic feedback device comprising:

a plate;

said plate providing an underside region;

said plate providing a surface terrain with a plurality of terrain features;

each of said terrain features providing a local XY plane and a local Z-axis;

each of said terrain features being characterized by a non-flat elevation profile on said local Z-axis;

said surface terrain comprising one or more overlapping terrain paths;

each of said terrain paths comprising a plurality of said terrain features;

a movable and magnetically-attractable control peg under said underside region;

a movable and magnetically-attractable escorted item on and supported by said surface terrain;

said escorted item and said control peg being magnetically coupled through said plate when placed in proximity to each other; and said escorted item remaining magnetically coupled to said control peg, while said escorted item is dragged back and forth, in an escorted trajectory across each of said terrain paths, by said control peg moving in a control trajectory.

2. The device of claim 1 wherein said underside region is substantially smooth.

3. The device of claim 1 wherein said control peg is confined to moving within a predetermined shape of said underside region.

4. The device of claim 1 wherein at least one of said terrain paths is substantially uneven, with significant changes with respect to said surface terrain on said local Z-axis.

5. The device of claim 1 wherein said escorted trajectory differs substantially from said control trajectory in at least one of said terrain paths, with significant changes with respect to said surface terrain on said local Z-axis.

6. The device of claim 1, further comprising:

one or more guardrails on said surface terrain;

each of said guardrails providing a guardrail XY plane; and each of said guardrails constraining said escorted trajectory in said guardrail XY plane and enabling said escorted trajectory to deviate from said control trajectory.

7. The device of claim 1 wherein an enclosure surrounds said surface terrain, to keep said escorted item within said device, when said escorted item is not magnetically coupled to said control peg.

8. The device of claim 1 wherein said device is held in a hand, such that physical contacts between said escorted item and said terrain features are felt haptically by said hand.

9. The device of claim 1 wherein said control peg is operable by one or more digits such that physical contacts between said escorted item and said terrain features are felt haptically by said digits.

10. The device of claim 1 wherein physical contacts between said escorted item and said terrain features produce acoustic feedback.

11. The device of claim 1 wherein said escorted item comprises a magnet.

12. The device of claim 1 wherein said control peg comprises a magnet.

13. The device of claim 1 wherein said escorted item takes a geometric shape including a sphere, a cube, and a disc.

14. The device of claim 1 wherein said terrain features of one of said terrain paths comprise:

a first valley on one end of said terrain path;

an upslope and a downslope, together forming a hill;

a second valley on another end of said terrain path; and said valleys and said hill providing a haptic sensation of turning on and off a light switch, when said escorted item is dragged back and forth between said two valleys.

15. The device of claim 1 wherein said terrain features of one of said terrain paths comprise:

two valleys, on two ends of said terrain path;

a plateau forming a substantial portion of said terrain path;

one or more bumps equally spaced on said plateau; and said valleys, plateau and bumps providing a haptic sensation of moving a discrete slide control on a dimmer switch, when said escorted item is dragged back and forth between said two valleys.

16. The device of claim 1, further comprising:

one of said terrain paths forming a loop;

a plurality of teeth-shaped terrain features evenly distributed over said loop; and said loop and teeth providing a haptic sensation of turning a mechanical ratchet, when said escorted item is dragged around said loop.

17. The device of claim 1 wherein said underside region comprises a curved surface.

18. The device of claim 1, further comprising one or more mechanical components that interact with said escorted trajectory of said escorted item.

19. The device of claim 1, further comprising one or more electric components including Hall effect sensors that interact with said escorted trajectory of said escorted item.

20. The device of claim 1 wherein said plate serves as an environmental seal to prevent environmental elements including air and water from penetrating said plate.

* * * * *